US011195478B2

(12) United States Patent
Lee et al.

(10) Patent No.: US 11,195,478 B2
(45) Date of Patent: Dec. 7, 2021

(54) DISPLAY APPARATUS AND METHOD OF CONTROLLING THE SAME

(71) Applicant: SAMSUNG ELECTRONICS CO., LTD., Suwon-si (KR)

(72) Inventors: Sanghoon Lee, Suwon-si (KR); Jeongil Kang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/991,396

(22) Filed: Aug. 12, 2020

(65) Prior Publication Data

US 2021/0049954 A1 Feb. 18, 2021

(30) Foreign Application Priority Data

Aug. 16, 2019 (KR) ..... 10-2019-0100089

(51) Int. Cl.
*G09G 3/34* (2006.01)

(52) U.S. Cl.
CPC ..... *G09G 3/342* (2013.01); *G09G 3/3406* (2013.01); *G09G 2330/02* (2013.01); *G09G 2330/045* (2013.01); *G09G 2330/12* (2013.01)

(58) Field of Classification Search
CPC ... G09G 3/3406–3426; G09G 2330/02; G09G 2330/045; G09G 2330/12
See application file for complete search history.

(56) References Cited

U.S. PATENT DOCUMENTS

2008/0204395 A1 8/2008 Kang et al.
2012/0050343 A1* 3/2012 Kim ..... G09G 3/3406 345/690
2013/0113844 A1 5/2013 Kim et al.
2017/0127484 A1 5/2017 Cao
2017/0339756 A1 11/2017 Ahn et al.

FOREIGN PATENT DOCUMENTS

KR 10-2013-0053536 5/2013
KR 10-2017-0010212 1/2017

OTHER PUBLICATIONS

Search Report dated Dec. 1, 2020 in counterpart International Patent Application No. PCT/KR2020/010774.

* cited by examiner

*Primary Examiner* — Gene W Lee
(74) *Attorney, Agent, or Firm* — Nixon & Vanderhye P.C.

(57) ABSTRACT

Disclosed is a display apparatus capable of preventing and/or reducing overheating of driving switches due to a malfunction during varying of a driving voltage. The display apparatus includes: a light emitting diode; a power supply configured to apply a driving voltage to the light emitting diode; a driving switch configured to control the driving current of the light emitting diode; a voltage sensor configured to detect the driving voltage; and a driving controller configured to control the driving switch so that the driving current of the light emitting diode follows a current reference. The driving controller may be configured, based on the driving voltage detected by the voltage sensor being greater than a predetermined voltage, to decrease the current reference to decrease the driving current of the light emitting diode.

18 Claims, 17 Drawing Sheets

DISPLAY APPARATUS AND METHOD OF CONTROLLING THE SAME

CROSS-REFERENCE TO RELATED APPLICATION

This application is based on and claims priority under 35 U.S.C. § 119 to Korean Patent Application No. 10-2019-0100089, filed on Aug. 16, 2019 in the Korean Intellectual Property Office, the disclosure of which is incorporated by reference herein in its entirety.

BACKGROUND

Field

The disclosure relates to a display apparatus and a method of controlling the same, and for example, to a display apparatus capable of preventing and/or reducing an overvoltage, and a method of controlling the same.

Description of Related Art

In the related art, display apparatuses may refer to output apparatuses displaying visual information converted from received or stored image information to users and have been widely used in various application fields such as individual homes or places of business.

For example, the display apparatuses may be monitor devices connected to personal computers or server computers, portable computer devices, navigation devices, televisions (TVs), Internet Protocol televisions (IPTVs), portable terminals such as smartphones, tablet personal computers (PCs), personal digital assistants (PDAs), or cellular phones, or various display apparatuses used to play advertisements or movies in the industrial field, or various types of audio/video systems.

Recently, the display apparatuses have been enlarged. Therefore, the number of light emitting diodes used to generate an image is increasing. In addition, a luminance of the display apparatus is increasing to expand the color gamut that the display apparatus can reproduce, and a light source in which a plurality of the light emitting diodes are connected in series is used to increase the luminance.

Since the plurality of light emitting diodes are connected in series, the variation in voltage applied to the plurality of light emitting diodes connected in series increases depending on an intensity of light output from each of the light emitting diodes.

The increase in the voltage deviation applied to the plurality of light emitting diodes may cause overheating of driving switches driving the plurality of light emitting diodes.

SUMMARY

Embodiments of the disclosure provide a display apparatus capable of varying a driving voltage applied to a plurality of light emitting diodes based on image data.

Embodiments of the disclosure provide a display apparatus capable of preventing and/or reducing overheating of driving switches due to a malfunction during varying of a driving voltage.

Embodiments of the disclosure provide a display apparatus capable of self-diagnosing a power supply that supplies a driving voltage to a plurality of light emitting diodes to prevent and/or reduce an overvoltage.

Additional aspects of the disclosure will be set forth in part in the description which follows.

In accordance with an example embodiment of the disclosure, a display apparatus includes: a light emitting diode; a power supply configured to apply a driving voltage to the light emitting diode and to supply a driving current to the light emitting diode; a driving switch configured to control the driving current of the light emitting diode; a voltage sensor configured to detect the driving voltage; and a driving controller configured to control the driving switch so that the driving current of the light emitting diode follows a current reference. The driving controller may be configured, based on the driving voltage detected by the voltage sensor being greater than a predetermined voltage, to decrease the current reference to decrease the driving current of the light emitting diode.

The driving controller may be configured, based on a time in which the detected driving voltage is greater than the predetermined voltage being greater than a reference time, to decrease the current reference to decrease the driving current of the light emitting diode.

The driving controller may be configured to transmit a feedback signal for adjusting the driving voltage based on the current reference to the power supply.

The driving controller may be configured, based on the feedback signal being substantially equal to an allowable minimum or maximum value and the detected driving voltage being greater than the predetermined voltage, to decrease the current reference to decrease the driving current of the light emitting diode.

The driving controller may be configured, based on the detected driving voltage rising while the feedback signal does not change, to decrease the current reference to decrease the driving current of the light emitting diode.

The power supply may include a power supply circuit configured to apply the driving voltage to the light emitting diode and a test circuit configured to diagnose the power supply circuit. The driving controller may be configured to detect a change in the driving voltage dependent on a change in the feedback signal, using the test circuit before driving the light emitting diode.

The driving controller may be configured, based on no change in the driving voltage being detected, to decrease the current reference to decrease the driving current of the light emitting diode.

The driving controller may be configured, based on power consumption of the driving switch being greater than a predetermined power and the detected driving voltage being greater than the predetermined voltage, to decrease the current reference to decrease the driving current of the light emitting diode.

The driving controller may be configured, based on the driving voltage detected by a first voltage sensor being greater than the predetermined voltage, to control the power supply to stop applying the driving voltage to the light emitting diode.

The display apparatus may further include a current sensor configured to detect the driving current. The driving controller may be configured to control the driving switch such that the driving current of the light emitting diode follows the current reference based on the detected driving current.

In accordance with another example embodiment of the disclosure, a method of controlling a display apparatus includes: applying, by a power supply, a driving voltage to a light emitting diode; controlling, by a driving switch, a driving current supplied to the light emitting diode to follow a current reference; detecting, by a voltage sensor, the driving voltage; and based on the detected driving voltage being greater than a predetermined voltage, decreasing, by a driving controller, the current reference to decrease the driving current of the light emitting diode.

The decreasing of the current reference may include, based on a time, in which the detected driving voltage is greater than the predetermined voltage being greater than a reference time, decreasing the current reference to decrease the driving current of the light emitting diode.

The method may further include, based on the detected driving voltage rising while a feedback signal for adjusting the driving voltage does not change, decreasing the current reference to decrease the driving current of the light emitting diode.

The method may further include, based on the driving voltage detected by a first voltage sensor being greater than the predetermined voltage, stopping applying the driving voltage to the light emitting diode.

The method may further include, based on a change in the driving voltage dependent on a change in a feedback signal for adjusting the driving voltage not being detected, decreasing the current reference to decrease the driving current of the light emitting diode.

In accordance with another example embodiment of the disclosure, a display apparatus includes: a light emitting diode; a power supply configured to apply a driving voltage to the light emitting diode and to supply a driving current to the light emitting diode; a driving switch configured to control the driving current of the light emitting diode; an edge sensor configured to detect a change in the driving voltage; and a driving controller configured to control the driving switch so that the driving current of the light emitting diode follows a current reference, and to transmit a feedback signal for adjusting the driving voltage based on the current reference to the power supply. The driving controller may be configured, based on the detected driving voltage rising while the feedback signal does not change, to decrease the current reference to decrease the driving current of the light emitting diode.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1:
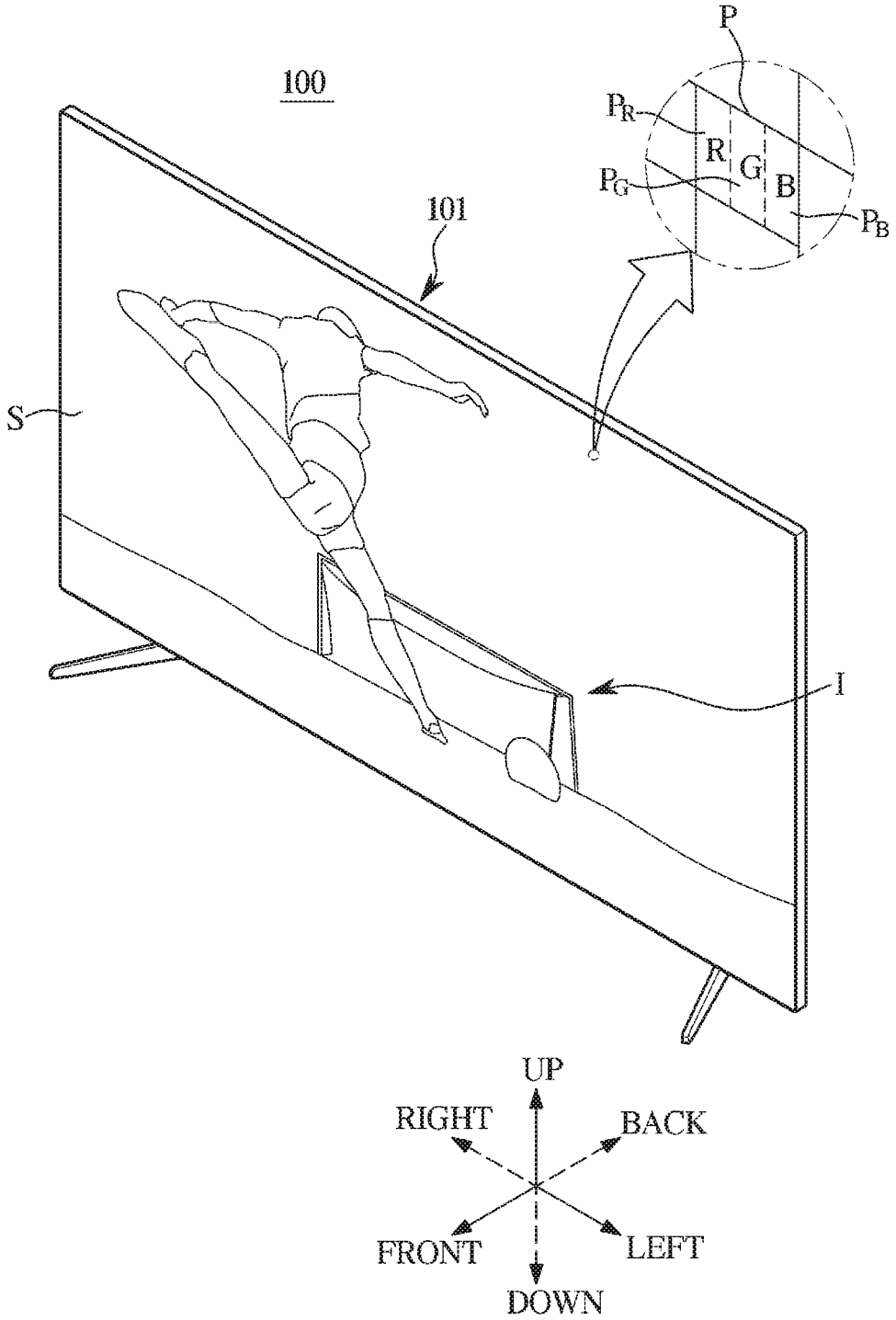
FIG. 1 is a diagram illustrating an example appearance of an example display apparatus according to an embodiment.

Like reference numerals refer to like elements throughout the disclosure. Not all elements of embodiments of the disclosure will be described, and description of what are commonly known in the art or what overlap each other in the embodiments may be omitted. The terms as used throughout the specification, such as "~ part," "~ module," "~ member," "~ block," etc., may be implemented in software and/or hardware, and a plurality of "~ parts," "~ modules," "~ members," or "~ blocks" may be implemented in a single element, or a single "~ part," "~ module," "~ member," or "~ block" may include a plurality of elements.

It will be understood that when an element is referred to as being "connected" to another element, it can be directly or indirectly connected to the other element, wherein the indirect connection includes "connection" via a wireless communication network.

When a part "includes" or "comprises" an element, unless there is a particular description contrary thereto, the part may further include other elements, not excluding the other elements.

Further, when it is stated that a layer is "on" another layer or substrate, the layer may be directly on another layer or substrate or a third layer may be disposed therebetween.

It will be understood that, although the terms first, second, third, etc., may be used herein to describe various elements, it should not be limited by these terms. These terms are simply used to distinguish one element from another element.

As used herein, the singular forms "a," "an" and "the" are intended to include the plural forms as well, unless the context clearly indicates otherwise.

An identification code may be used for the convenience of the description but is not intended to illustrate the order of each operation. Each of the operations may be implemented in an order different from the illustrated order unless the context clearly indicates otherwise.

Hereinafter, the operation principles and example embodiments of the disclosure will be described with reference to the accompanying drawings.

FIG. 1 is a diagram illustrating an example appearance of an example display apparatus according to an embodiment.

A display apparatus 100 may be, for example, an apparatus capable of processing an image signal received from the outside (e.g., external image source) and visually displaying the processed image. As illustrated in FIG. 1, the display apparatus 100 may be implemented as a TV, but the embodiment of the display apparatus 100 is not limited thereto. For example, the display apparatus 100 may be implemented as a monitor of a computer, or may be included in a navigation terminal device or various portable terminal devices. The portable terminal devices may include, for example, and without limitation, a desktop computer, a laptop computer, a smartphone, a tablet personal computer (PC), a wearable computing device, a personal digital assistant (PDA), or the like.

In addition, the display apparatus 100 may be a large format display (LFD) installed outdoors such as on a building roof or at a bus stop. The outdoors is not necessarily limited to the outside, but should be understood as a concept including a place where a large number of people can go in and out, even an area such as a subway station, a shopping mall, a movie theater, a company, a store, etc.

The display apparatus 100 may receive a video signal and an audio signal from various content sources, and may output video and audio corresponding to the video signal and the audio signal. For example, the display apparatus 100 may receive television broadcast content through a broadcast receiving antenna or a cable, receive content from a content reproduction device, or receive the content from a content providing server of a content provider.

As illustrated in FIG. 1, the display apparatus 100 may include a main body 101 accommodating a plurality of components for displaying an image I and a screen S provided on one surface of the main body 101 to display the image I.

The main body 101 may form an appearance of the display apparatus 100 and the component for displaying the image I by the display apparatus 100 may be provided in the inside of the main body 101. The main body 101 illustrated in FIG. 1 may be in the form of a flat plate, but the shape of the main body 101 is not limited to that illustrated in FIG. 1. For example, the main body 101 may have a shape in which left and right ends protrude forward and a center part is curved so as to be concave.

The screen S may be formed on the front surface of the main body 101, and the screen S may display the image I as visual information. For example, a still image or a moving image may be displayed on the screen S, and a two-dimensional plane image or a three-dimensional stereoscopic image may be displayed.

A plurality of pixels P may be formed on the screen S, and the image I displayed on the screen S may be formed by a combination of light emitted from the plurality of pixels P. For example, the single image I may be formed on the screen S by combining the light emitted by the plurality of pixels P with a mosaic.

Each of the plurality of pixels P may emit the light of various brightness and various colors.

Each of the plurality of pixels P may include a configuration (for example, an organic light emitting diode) capable of emitting the light directly in order to emit the light of various brightness, or a configuration (for example, a liquid crystal panel) capable of transmitting or blocking the light emitted by a backlight unit or the like.

In order to emit the light of various colors, each of the plurality of pixels P may include subpixels $P_r$, $P_g$, and $P_b$.

The subpixels $P_r$, $P_g$, and $P_b$ may emit light. The red subpixel $P_r$ may emit red light, the green subpixel $P_g$ may emit green light, and the blue subpixel $P_b$ may emit blue light. For example, red light may represent light having a wavelength in a range of substantially 620 nm (nanometer) to 750 nm, green light may represent light having a wavelength in a range of substantially 495 nm to 570 nm, and blue light may represent light having a wavelength in a range of substantially 450 nm to 495 nm.

By the combination of the red light of the red subpixel $P_r$, the green light of the green subpixel $P_g$, and the blue light of the blue subpixel $P_b$, each of the plurality of pixels P may emit the light of various brightness and various colors.

The screen S may be provided in the flat plate shape as illustrated in FIG. 1. However, the shape of the screen S is not limited to that illustrated in FIG. 1. It may be provided in a shape in which both ends protrude forward and a center portion is curved so as to be concave according to the shape of the main body 101.

The display apparatus 100 may include various types of display panels for displaying the image. For example, the display apparatus 100 may include, for example, and without limitation, a liquid crystal display (LCD) panel, a light emitting diode (LED) panel, an organic light emitting diode (OLED) panel, or the like.

Figure 2:
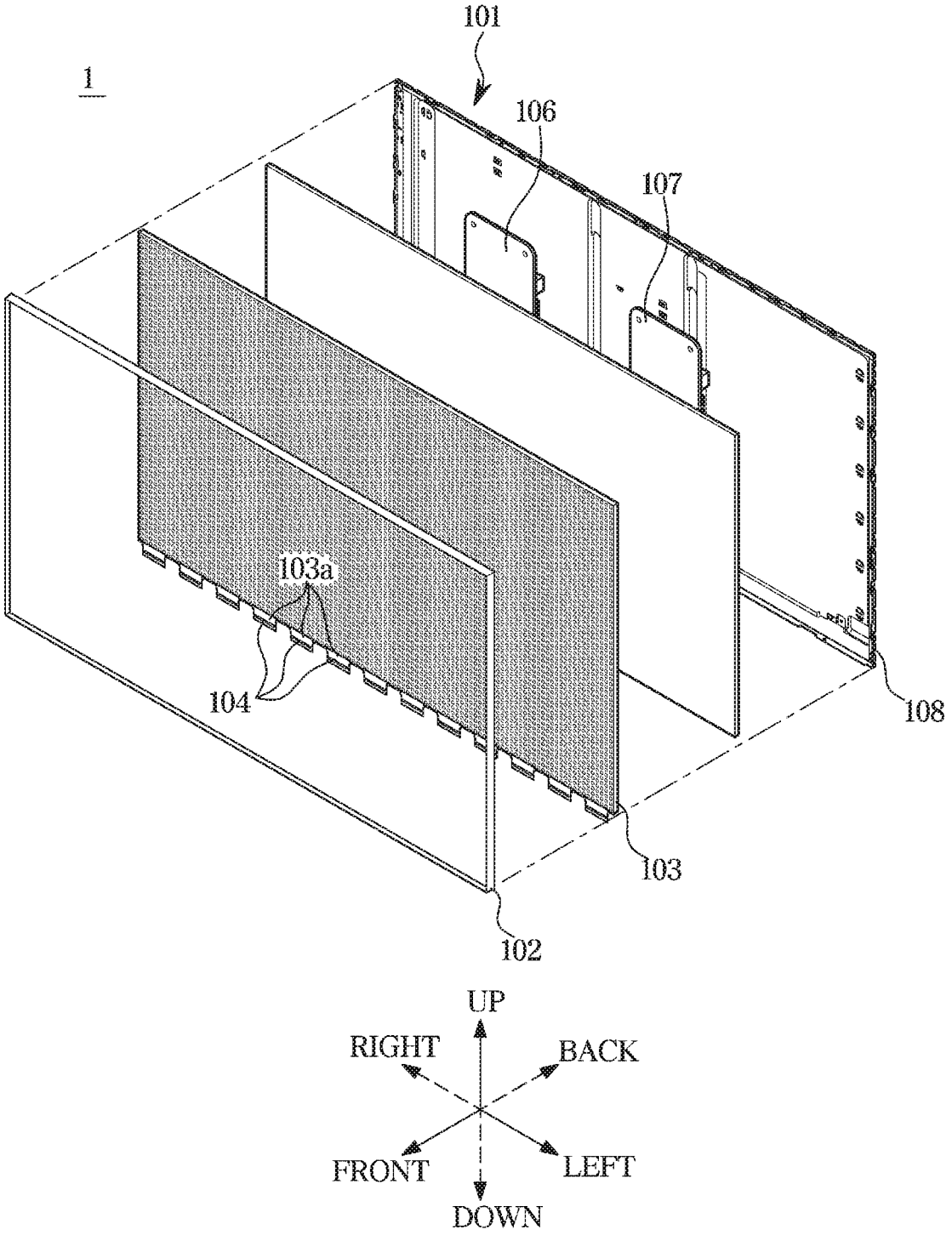
FIG. 2 is an exploded perspective view illustrating an example display apparatus according to an embodiment.

FIG. 2 is an exploded perspective view illustrating an example display apparatus according to an embodiment.

As illustrated in FIG. 2, various components for generating the image I on the screen S may be provided in the main body 101.

For example, the main body 101 may include a display panel 103 for emitting light forward to generate the image, a control assembly 106 mounted with a configuration for controlling an operation of the display panel 103, a power supply assembly 107 mounted with a configuration for supplying power to the display panel 103 and the control assembly 106, a bottom chassis 108 for supporting/fixing the control assembly 106 and the power supply assembly 107, and a bezel 102 and a rear cover 70 for preventing and/or avoiding the display panel 103, the control assembly 106, and the power supply assembly 107 from being exposed to the outside.

The front surface of the display panel 103 (surface on which light is emitted) may form the screen S of the display apparatus 100 described above, and the display panel 103 may form the pixels P or the subpixels $P_r$, $P_g$ and $P_b$ described above.

On one side of the display panel 103, a cable 103*a* for transmitting image data to the display panel 103, and a display driver integrated circuit (DDI) 104 (hereinafter referred to as 'driver IC') for processing digital image data and outputting an analog image signal may be provided.

The cable 103*a* may electrically connect between the control assembly 106 and the power supply assembly 107 described above and the driver IC 104, and may also electrically connect between the driver IC 104 and the display panel 103. The cable 103*a* may include a flexible flat cable or a film cable that can be bent.

The driver IC 104 may receive the image data and the power from the control assembly 106 and the power supply assembly 107 through the cable 103*a*, and may supply the image signal and a driving current to the display panel 103 through the cable 103*a*.

The cable 103*a* and the driver IC 104 may be integrally implemented as a film cable, a chip on film (COF), a tape carrier packet (TCP), or the like. In other words, the driver IC 104 may be disposed on the cable 103*a*. However, the present disclosure is not limited thereto, and the driver IC 104 may be disposed on the display panel 103 or the control assembly 106.

The control assembly 106 may include a control circuit that controls the operation of the display panel 103. The control circuit may process the image data received from an external content source and transmit the image data to the display panel 103 so that the plurality of pixels P emit light having different colors and different brightness.

The power supply assembly 107 may supply the power to the display panel 103 so that the plurality of pixels P emit light having different colors and different brightness.

The control assembly 106 and the power supply assembly 107 may be implemented with a printed circuit board and various circuits mounted on the printed circuit board. For example, the power supply circuit may include a capacitor, a coil, a resistance element, a microprocessor, and the like, and a power supply circuit board on which they are mounted. Further, the control circuit may include a memory, the microprocessor, and a control circuit board on which they are mounted.

Figure 3:
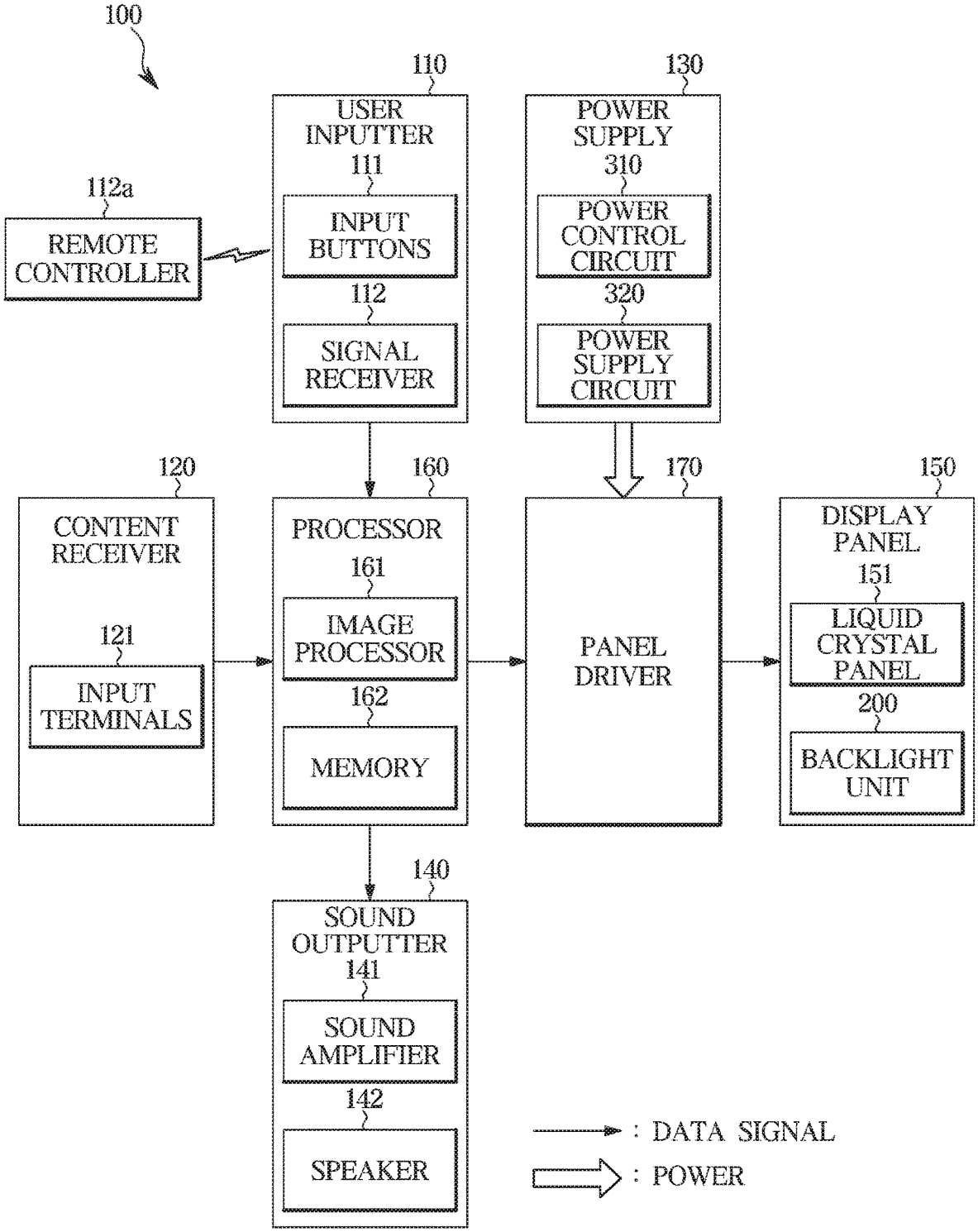
FIG. 3 is a block diagram illustrating an example configuration of a display device according to an embodiment.
Figure 4:
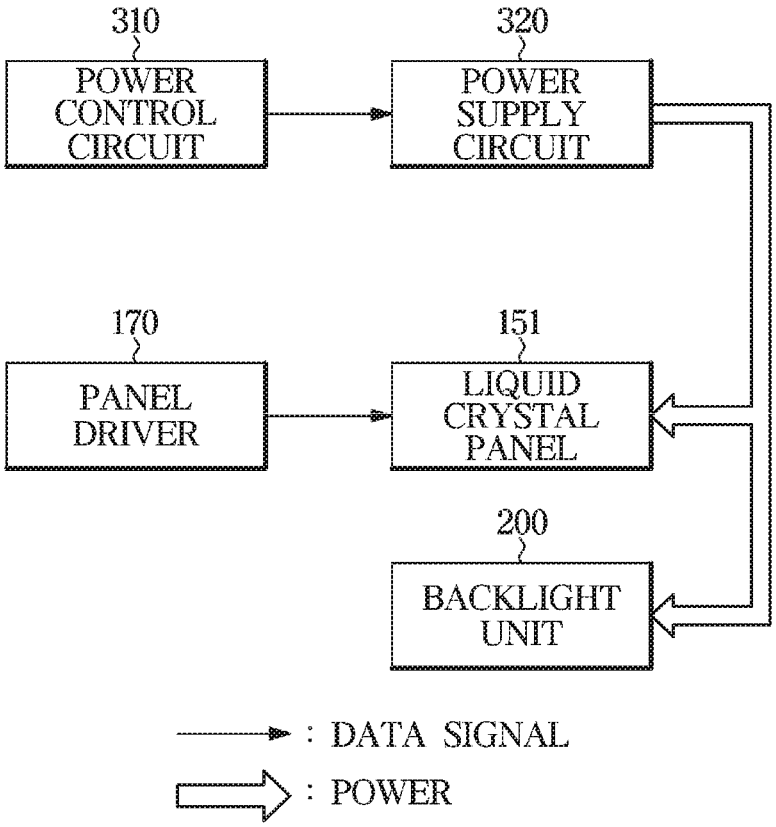
FIG. 4 is a diagram illustrating a display panel, a panel driver, and a power supply of a display apparatus according to an embodiment.

FIG. 3 is a block diagram illustrating an example configuration of a display device according to an embodiment, and FIG. 4 is a diagram illustrating a display panel, a panel driver, and a power supply of a display apparatus according to an embodiment.

Referring to FIGS. 3 and 4, the display apparatus 100 may include a user inputter (e.g., including input circuitry) 110 for receiving a user input from a user, a content receiver (e.g., including receiving circuitry) 120 for receiving a video signal and/or an audio signal from the content sources, a processor (e.g., including processing circuitry) 160 for processing the video signal and/or the audio signal received by the content receiver 120 and controlling an operation of the display apparatus 100, a power supply 130 for supplying power to components of the display apparatus 100, a sound outputter (e.g., including sound output circuitry) 140 for outputting sound processed by the processor 160, a display panel 150 for displaying an image, and a panel driver (e.g., including driving circuitry) 170 for transmitting image data processed by the processor 160 to the display panel 150.

The user inputter 110 may include various input circuitry including, for example, and without limitation, input buttons 111 for receiving the user input. For example, the user inputter 110 may include a power button for turning on or off the display apparatus 100, a sound control button for adjusting the volume of the sound output by the display apparatus 100, a source selection button for selecting the content source, and the like.

The input buttons 111 may each receive the user input and output an electrical signal corresponding to the user input to the processor 160. The input buttons 111 may be implemented by various input devices, such as, for example, and without limitation, a push switch, a touch switch, a dial, a slide switch, a toggle switch, and the like.

The user inputter 110 may also include a signal receiver 112 including various receiving circuitry for receiving a remote control signal of a remote controller 112*a*. The remote controller 112*a* for receiving the user input may be provided separately from the display apparatus 100, and may receive the user input and transmit a radio signal corresponding to the user input to the display apparatus 100. The signal receiver 112 may receive the radio signal corresponding to the user input from the remote controller 112*a* and output an electrical signal corresponding to the user input to the processor 160.

The content receiver 120 may include various receiving circuitry including, for example, input terminals 121 that receive the video signal and/or the audio signal from the content sources.

The input terminals 121 may receive the video signal and the audio signal from the content sources through the cable. For example, the input terminals 121 may be a component (YPbPr/RGB) terminal, a composite (composite video blanking and sync (CVBS)) terminal, an audio terminal, a high definition multimedia interface (HDMI) terminal, a universal serial bus (USB) terminal, and the like.

The content receiver 120 may further include a tuner. The tuner may receive broadcast signals through the broadcast receiving antenna or a wired cable and extract a broadcast signal of a channel selected by the user from the broadcast signals. For example, the tuner may pass a broadcast signal having a frequency corresponding to a channel selected by the user among a plurality of the broadcast signals received through the broadcast receiving antenna or the wired cable, and block the broadcast signals having other frequencies.

As such, the content receiver 120 may receive the video signal and the audio signal from the content sources through the input terminals 121, and may output the video signal and the audio signal received through the input terminals 121 to the processor 160.

The processor 160 may include various processing circuitry, including, for example, an image processor 161 for processing data and a memory 162 for storing data.

The memory 162 may store programs and data for controlling the display apparatus 100 and temporarily store the data generated while the display apparatus 100 is being controlled.

In addition, the memory 162 may store the programs and data for processing video signals and/or audio signals, and temporarily store the data generated during the processing of the video signals and/or audio signals.

The memory 162 may include a non-volatile memory such as ROM or flash memory for storing the data for a long period of time, or a volatile memory such as static random access memory (S-RAM) or dynamic random access memory (D-RAM) for temporarily storing the data.

The image processor 161 may receive the video signal and/or the audio signal from the content receiver 120, decode the video signal to generate image data, and decode the audio signal to generate sound data. The image data and the sound data may be output to the panel driver 170, the display panel 150 and the sound outputter 140, respectively.

In addition, the image processor 161 may receive the user input from the user inputter 110, the content receiver 120, and/or the display panel 150, and/or the panel driver 170 and/or the sound outputter 140 according to the user input.

The image processor 161 may include an operation circuit to perform logic operations and arithmetic operations and a memory circuit to temporarily store computed data.

The processor 160 may process the video signal and/or the audio signal received by the content receiver 120, and reproduce the image and the sound from the video signal and/or the audio signal. For example, the processor 160 may decode the video signal and/or the audio signal, and may restore the image data and the sound data from the video signal and/or the audio signal.

The processor 160 may convert the sound data decoded from the audio signal into an analog sound signal, and a sound amplifier 141 may amplify the analog sound signal output from the processor 160.

In addition, the processor 160 may control operations of the content receiver 120, the display panel 150, the panel driver 170, and the sound outputter 140 according to the user input. For example, when the content source is selected by the user input, the processor 160 may control the content receiver 120 to receive the video signal and/or the audio signal from the selected content source.

The processor 160 may be implemented as the control circuit in the control assembly 106 illustrated in FIG. 2.

The sound outputter 140 may include various sound output circuitry, including, for example, the sound amplifier 141 for amplifying sound, and a speaker 142 for audibly outputting the amplified sound.

The speaker 142 may convert the analog sound signal amplified by the sound amplifier 141 into an audible sound. For example, the speaker 142 may include a thin film that vibrates according to an electrical sound signal, and sound waves may be generated by the vibration of the thin film.

The display panel 150 may generate an image according to the image data received from the panel driver 170, and display the image.

The display panel 150 may include a pixel serving as a unit for displaying the image. Each of the pixels may receive an electrical signal representative of the image from the panel driver 170 and output an optical signal corresponding to the received electrical signal. As described above, the optical signals output by the plurality of pixels P may be combined and displayed on the display panel 150.

The display panel 150 may include a backlight unit 200 configured to emit a surface light forward, and a liquid crystal panel 151 configured to block or pass light emitted from the backlight unit 200.

The backlight unit 200 may include a point light source (e.g., light emitting diode, etc.) that emits monochromatic light or white light, and an optical member that refracts, reflects, and scatters the light to convert the light emitted from the point light source into uniform surface light (e.g., light guide plate or diffuser plate).

In addition, the backlight unit 200 may perform local dimming to extremely adjust the luminance of the display panel 150. For example, the backlight unit 200 may turn off the light emitting diode provided at a specific location and turn on the light emitting diode provided at another location.

The screen S of the display apparatus 100 may be divided into a plurality of regions in order to improve a contrast ratio and a dynamic range of the image, and the backlight unit 200 may individually control a plurality of light emitting diodes LED1 to LED8 (see FIG. 5) positioned in the plurality of regions. For example, a driving control signal for controlling the operation of the plurality of light emitting diodes may be transmitted to the plurality of light emitting diodes, and each of the plurality of light emitting diodes may adjust an output intensity of light depending on the driving control signal.

The liquid crystal panel 151 may form the screen S of the display apparatus 100 illustrated in FIG. 1, and may include the plurality of pixels P. Each of the plurality of pixels P included in the liquid crystal panel 151 may independently block or pass the light of the backlight unit 200, and the light passed by the plurality of pixels P may form the image I displayed on the screen S.

The display panel 150 may output the image having a wider range luminance using the backlight unit 200 that can extremely adjust the intensity of light and the liquid crystal panel 151 that can adjust a transmittance of light.

The panel driver 170 may include various driving circuitry and receive the image data from the processor 160 and may drive the display panel 150 to display the image corresponding to the received image data.

The panel driver 170 may transmit the image data to each of the plurality of pixels included in the liquid crystal panel 151. Each of the plurality of pixels may transmit light (transmittance of light may be adjusted) depending on the received image data, and the light passing through each of the plurality of pixels may be combined to form the image.

The panel driver 170 may be implemented as the driver IC 104 illustrated in FIG. 2.

The power supply 130 may supply power to the display panel 150.

The power supply 130 may include a power supply circuit 320 that receives AC power from an external power source and converts the received AC power into DC power, and a power control circuit 310 for controlling the power supply circuit 320 to adjust the voltage applied to the display panel 150.

The power supply circuit 320 may supply power to the liquid crystal panel 151 and the backlight unit 200 as illustrated in FIG. 4.

The power supply circuit 320 may adjust a driving voltage applied to the backlight unit 200 and supply the driving current required for the operation of the backlight unit 200. The power supply circuit 320 may include a switching mode power supply (SMPS).

The power control circuit 310 may control the power supply circuit 320 to adjust the voltage applied to the backlight unit 200 according to the operation of the backlight unit 200. For example, in response to an increase in the driving current of the backlight unit 200, the power control circuit 310 may control the power supply circuit 320 to increase the voltage applied to the backlight unit 200. In addition, in response to a decrease in the driving current of the backlight unit 200, the power control circuit 310 may control the power supply circuit 320 to decrease the voltage applied to the backlight unit 200.

The power supply 130 may supply power not only to the display panel 150 but also to the user inputter 110, the content receiver 120, the processor 160, the sound outputter 140, the panel driver 170, and all other components.

The power supply 130 may be implemented as a power circuit in the display panel 150 illustrated in FIG. 2.

Figure 5:
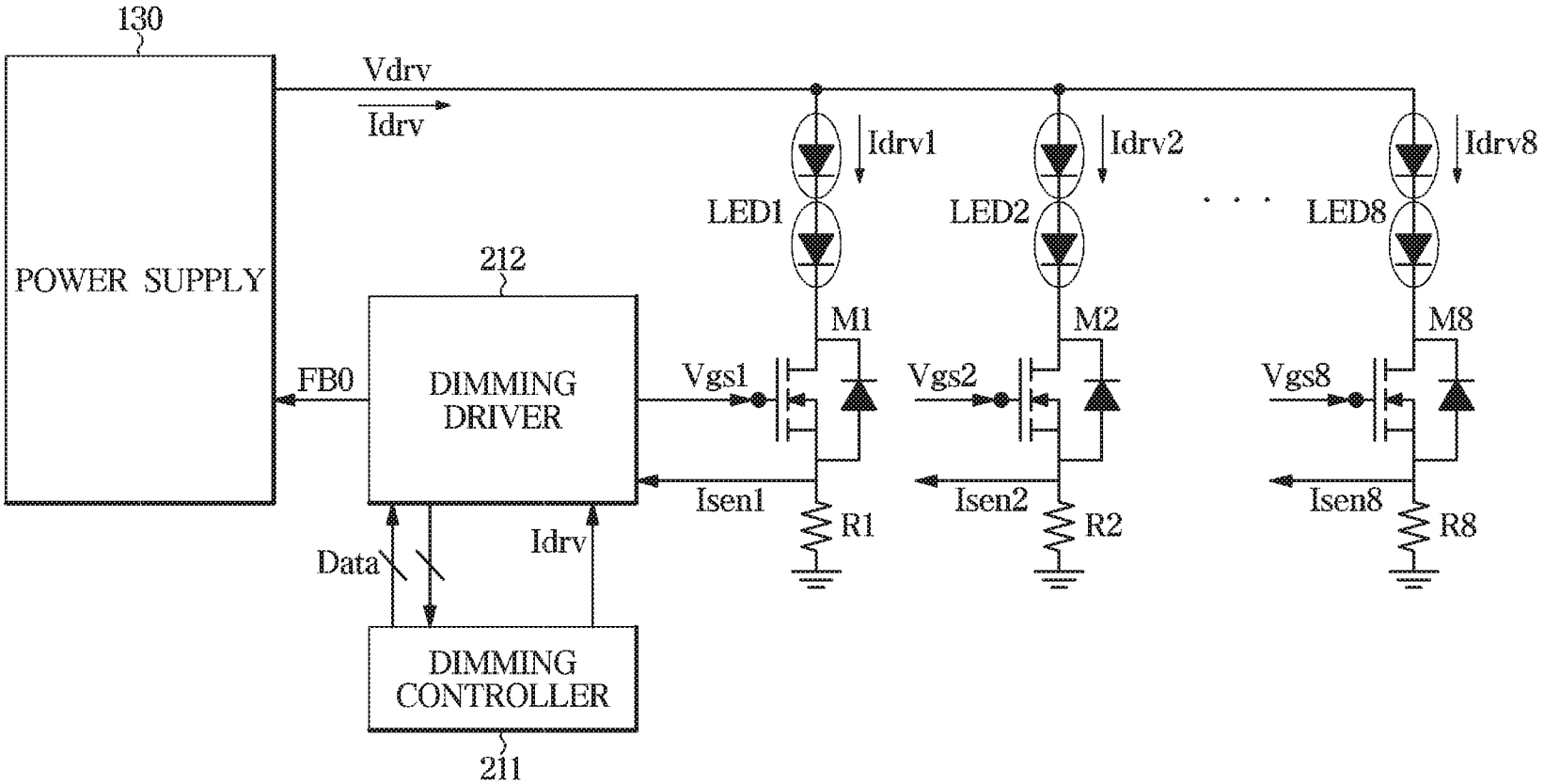
FIG. 5 is a circuit diagram illustrating an example of a backlight unit of a display apparatus according to an embodiment.

FIG. 5 is a circuit diagram illustrating an example of a backlight unit of a display apparatus according to an embodiment.

Referring to FIG. 5, the backlight unit 200 may include the plurality of light emitting diodes LED1 to LED8.

The plurality of light emitting diodes LED1 to LED8 may be respectively supplied with power from the power supply 130. The power supply 130 may apply a driving voltage Vdrv to the plurality of light emitting diodes LED1 to LED8, and may supply a driving current Idrv to follow a current reference Idrv* to the plurality of light emitting diodes LED1 to LED8.

The plurality of light emitting diodes LED1 to LED8 may be divided into a plurality of groups. For example, as illustrated in FIG. 5, the plurality of light emitting diodes LED1 to LED8 may include the first group light emitting diodes LED1. In the same or similar manner, the plurality of light emitting diodes LED1 to LED8 may include the second to eighth group light emitting diodes LED2 to LED8. The light emitting diodes belonging to one group may be connected to each other in series.

The light emitting diodes LED1 to LED8 belonging to the plurality of groups (hereinafter, referred to as 'group light emitting diodes') may be integrally formed as one light source, or may be positioned adjacent to each other on the screen S of the display apparatus 100. Further, the plurality of light emitting diodes LED1 to LED8 may be individually controlled by a plurality of driving switches M1 to M8.

As illustrated in FIG. 5, the backlight unit 200 may further include the plurality of driving switches M1 to M8 that control the driving current supplied to the plurality of light emitting diodes LED1 to LED8.

Light emitted from the plurality of light emitting diodes LED1 to LED8 may be refracted, reflected, and/or scattered by the light guide plate or the diffusion plate. The backlight unit 200 may emit surface light having a uniform intensity by refraction, reflection, and/or scattering of light.

The plurality of driving switches M1 to M8 may control driving currents Idrv1 to Idrv8 supplied to one group of the light emitting diodes LED1 to LED8, respectively.

For example, the first driving switch M1 may control the supply of driving current to the first group light emitting diodes LED1. In the same or similar way, the second to eighth driving switches M2 to M8 may control the supply of driving current to the second to eighth group light emitting diodes LED2 to LED8.

By the operation of the plurality of driving switches M1 to M8, the backlight unit 200 may emit surface light having extremely different light intensity (luminance).

The plurality of driving switches M1 to M8 may each employ a metal oxide semiconductor field effect transistor (MOSFET), a bipolar junction transistor (BJT), or an insulated gate bipolar transistor (IGBT).

The backlight unit 200 may also include a plurality of shunt resistors R1 to R8 for detecting the driving current supplied to the plurality of light emitting diodes LED1 to LED8. For example, as illustrated in FIG. 5, the plurality of shunt resistors R1 to R8 may include the first to eighth shunt resistors R1 to R8.

Each of the plurality of shunt resistors R1 to R8 may be a current sensor. The plurality of shunt resistors R1 to R8 may be provided between the plurality of light emitting diodes LED1 to LED8 and a ground, and may output a detecting signal indicating a current detecting signal Isen actually supplied to the plurality of light emitting diodes LED1 to LED8. For example, the detecting signal may be a potential difference (voltage) between both ends of the plurality of shunt resistors R1 to R8.

As illustrated in FIG. 5, the backlight unit 200 may further include a dimming driver 212 including circuitry for controlling the driving current of the plurality of light emitting diodes LED1 to LED8 and a dimming controller 211 including circuitry for controlling the dimming driver 212.

The dimming controller 211 may receive dimming data for local dimming from the processor 160. The dimming data may include information regarding extreme luminance of an image. In addition, the dimming controller 211 may control the dimming driver 212 to control the driving current of the backlight unit 200.

The dimming controller 211 may determine the extreme luminance of the backlight unit 200 based on the dimming data. Also, the dimming controller 211 may determine the intensity of light emitted from the plurality of light emitting diodes LED1 to LED8 based on the dimming data. Further, the dimming controller 211 may determine values of the current reference Idrv* to be supplied to the plurality of light emitting diodes LED1 to LED8 based on the dimming data. For example, the dimming controller 211 may determine values of first to eighth current references Idrv1* to Idrv8*.

The dimming controller 211 may transmit values of the current reference Idrv* determined based on the dimming data to the dimming driver 212.

The dimming driver 212 may receive the values of the current reference Idrv* from the dimming controller 211, and may control the plurality of driving switches M1 to M8 such that the current reference Idrv* is supplied to the plurality of light emitting diodes LED1 to LED8. Further, the dimming driver 212 may turn on the plurality of driving switches M1 to M8 to allow the driving current or turn off the plurality of driving switches M1 to M8 to block the driving current.

The dimming driver 212 may output a switching control signal Vgs to a control terminal (e.g., gate terminal of the MOSFET or base terminal of the BJT) of each of the plurality of driving switches M1 to M8.

For example, the dimming driver 212 may output a first switching control signal Vgs1 corresponding to the first driving current Idrv1 to the first driving switch M1. In the same or similar way, the dimming driver 212 may output second to eighth switching control signals Vgs2 to Vgs8 corresponding to the second to eighth driving currents Idrv2 to Idrv8 to the second to eighth driving switches M2 to M8.

The dimming driver 212 may receive the detecting signal output from the plurality of shunt resistors R1 to R8, and may determine the driving current Idrv based on the current detecting signal Isen.

The dimming driver 212 may adjust the switching control signal Vgs based on the comparison between the driving current Idrv and the current reference Idrv*. For example, when the driving current Idrv is greater than the current reference Idrv*, the dimming driver 212 may decrease the switching control signal Vgs. In addition, when the driving current Idrv is less than the current reference Idrv*, the dimming driver 212 may increase the switching control signal Vgs.

The dimming driver 212 may also output a first feedback signal FB0 for adjusting the driving voltage Vdrv to the power supply 130 depending on the current reference Idrv*.

When the current reference Idrv* is not supplied to the plurality of light emitting diodes LED1 to LED8 only by controlling the driving switches M1 to M8, the dimming driver 212 may output the first feedback signal FB0 for increasing the driving voltage Vdrv to the power supply 130.

Further, the dimming driver 212 may output the first feedback signal FB0 for decreasing the driving voltage Vdrv depending on the current reference Idrv* to the power supply 130, in order to decrease power consumption of the driving switches M1 to M8. For example, the dimming driver 212 may output the first feedback signal FB0 for decreasing the driving voltage Vdrv to the power supply 130 depending on the reduction of the current reference Idrv*.

It is known that the intensity of light emitted from the light emitting diodes LED1 to LED8 depends on the current of the light emitting diodes LED1 to LED8, that is, the driving current Idrv. In addition, it is known that the driving current Idrv depends on the voltage applied to both ends of the light emitting diodes LED1 to LED8. Particularly, as the driving current Idrv decreases, the voltage applied to both ends of the light emitting diodes LED1 to LED8 may also decrease.

The driving voltage Vdrv may be applied to the light emitting diodes LED1 to LED8 belonging to one group, and the light emitting diodes LED1 to LED8 belonging to one group may be connected in series with each other. Therefore, a decrease in voltage applied to both ends of the light emitting diodes LED1 to LED8 may be accumulated in one group.

The decreased voltage may be applied to the plurality of driving switches M1 to M2, and the voltage applied to both ends of the plurality of driving switches M1 to M2 may increase. At this time, the power consumption of the driving switches M1 to M8 may be calculated as a product of current and voltage. That is, the power consumption of the driving switches M1 to M8 may be calculated as a product of the difference between the driving voltage Vdrv and the voltage drop of the light emitting diodes LED1 to LED8 and the driving current Idrv.

Figure 6:
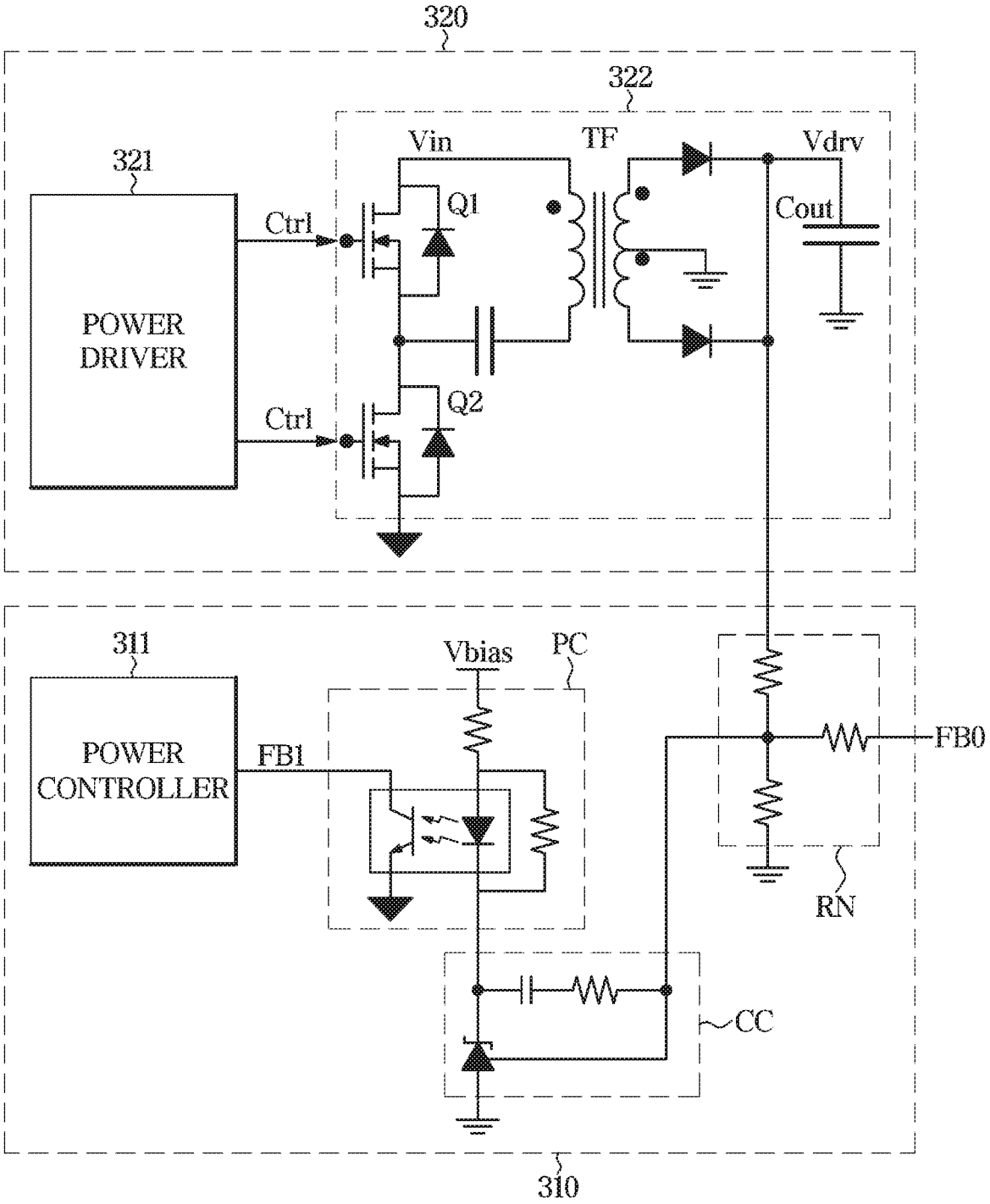
FIG. 6 is a circuit diagram illustrating an example of a power supply of a display apparatus according to an embodiment.

FIG. 6 is a circuit diagram illustrating an example of a power supply of a display apparatus according to an embodiment.

The power supply 130 may supply power to the plurality of light emitting diodes LED1 to LED8, and may also adjust the driving voltage Vdrv depending on the first feedback signal FB0.

As illustrated in FIG. 6, the power supply 130 may include the power supply circuit 320 and the power control circuit 310.

The power supply circuit 320 may include a rectifying circuit for rectifying external AC power and a DC-DC conversion circuit 322 for converting the voltage of the rectified AC power.

The DC-DC conversion circuit 322 may include an LLC converter (Inductor-Inductor-Capacitor converter). The LLC converter may include a pair of conversion switches Q1 and Q2 connected in series with each other, a transformer TF for converting the voltage, and an output capacitor Cout. The output voltage of the output capacitor Cout may be varied depending on an on/off switching frequency of the pair of conversion switches Q1 and Q2.

The power supply circuit 320 may include a power driver 321 that controls on/off of the pair of conversion switches Q1 and Q2. The power driver 321 may control the on/off switching frequency of the pair of conversion switches Q1 and Q2 in response to a power control signal received from a power controller 311.

The power control circuit 310 may include, for example, a resistance network RN, a clamping circuit CC, and a photo coupler PC. The resistance network RN may receive the first feedback signal FB0 of the backlight unit 200 and change a voltage level of the first feedback signal FB0. The clamping circuit CC may clamp the output voltage of the resistance network RN. The photo coupler PC may separate the power circuit and the backlight unit 200 and output a second feedback signal FB1 depending on the first feedback signal FB0.

The power control circuit 310 may further include the power controller 311.

The power controller 311 may receive the second feedback signal FB1 and control the operation of the power driver 321 depending on the second feedback signal FB1. For example, the power controller 311 may output a power control signal for increasing the driving voltage Vdrv depending on the second feedback signal FB1 or may output a power control signal for decreasing the driving voltage Vdrv depending on the second feedback signal FB1.

Figure 7:
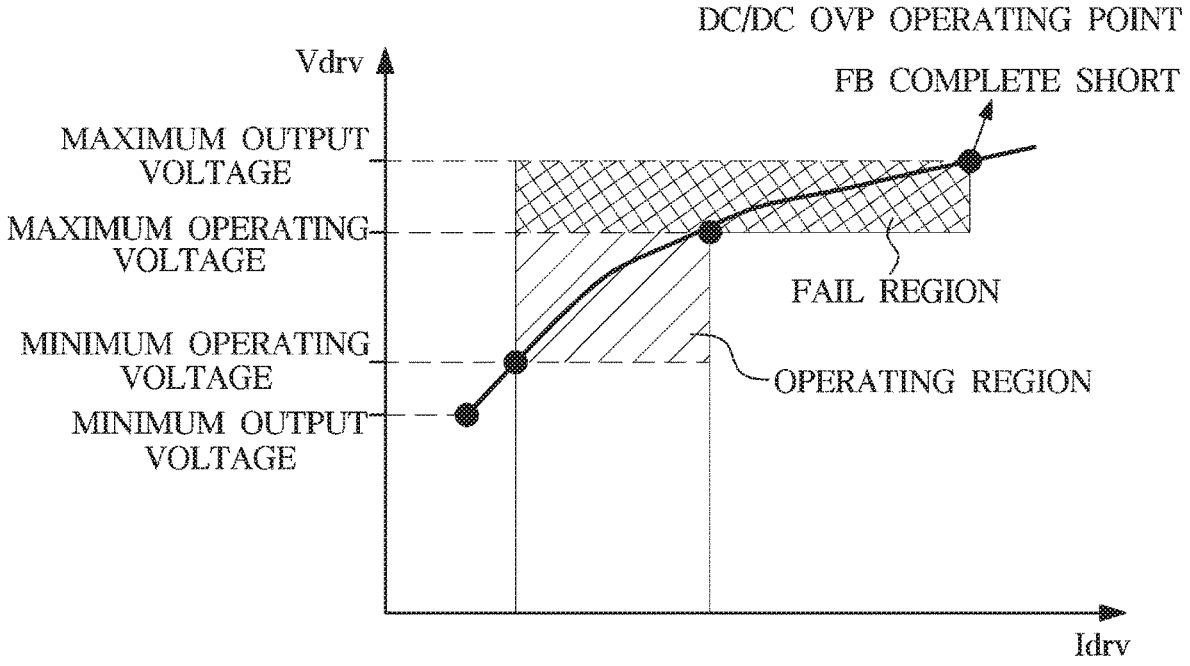
FIG. 7 is a graph illustrating a relationship between a driving voltage and a driving current applied to a light emitting diode by the power supply illustrated in FIG. 6 according to an embodiment.

FIG. 7 is a graph illustrating a relationship between a driving voltage and a driving current applied to a light emitting diode by the power supply illustrated in FIG. 6 according to an embodiment.

As illustrated in FIG. 7, the power supply 130 may change the driving voltage Vdrv in response to a change in the driving current Idrv. For example, the power supply 130 may change the driving voltage Vdrv based on the first feedback signal FB0 depending on the change in the driving current Idrv.

The voltage that the power supply 130 can provide to the backlight unit 200 may be limited by a minimum output voltage and a maximum output voltage. For example, the minimum output voltage and the maximum output voltage may be defined based on a voltage that can be stably output by the on/off switching frequency of the pair of conversion switches Q1 and Q2 of the DC-DC conversion circuit 322.

In addition, the driving voltage Vdrv may be limited by a minimum operating voltage and a maximum operating voltage so that the light emitting diodes LED1 to LED8 included in the backlight unit 200 operate stably. For example, the backlight unit 200 may operate normally even if the driving voltage Vdrv instantaneously becomes greater than or equal to the maximum operating voltage.

However, when the driving voltage Vdrv continuously exceeds the maximum operating voltage, the driving switches M1 to M8 may be damaged due to overheating. In addition, when the driving switches M1 to M8 are damaged and short-circuited, an overcurrent may be supplied to the light emitting diodes LED1 to LED8 and the light emitting diodes LED1 to LED8 may also be damaged.

The minimum output voltage and the maximum output voltage of the power supply 130 may not match the minimum operating voltage and the maximum operating voltage of the backlight unit 200. For example, the minimum output voltage may be less than the minimum operating voltage, and the maximum output voltage may be larger than the maximum operating voltage.

In addition, the power supply 130 may include a protection circuit, and the protection circuit may stop the operation of the power supply circuit 320 when the driving voltage Vdrv of the backlight unit 200 is greater than the maximum output voltage.

However, when the driving voltage Vdrv is greater than the maximum operating voltage of the backlight unit 200 and less than the maximum output voltage of the power supply 130, the protection circuit may not operate.

Figure 8:
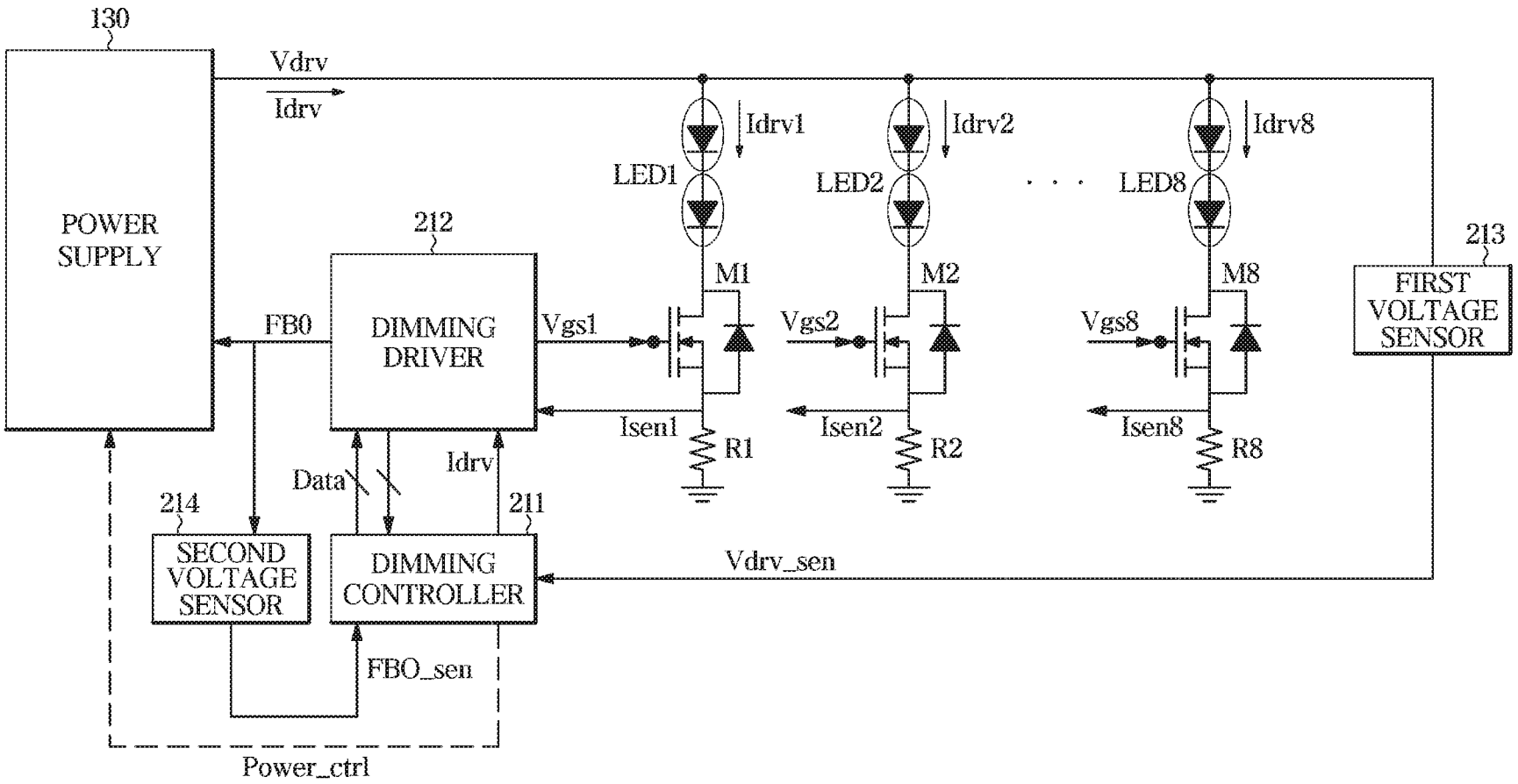
FIG. 8 is a circuit diagram illustrating another example of a backlight unit of a display apparatus according to an embodiment.
Figure 9:
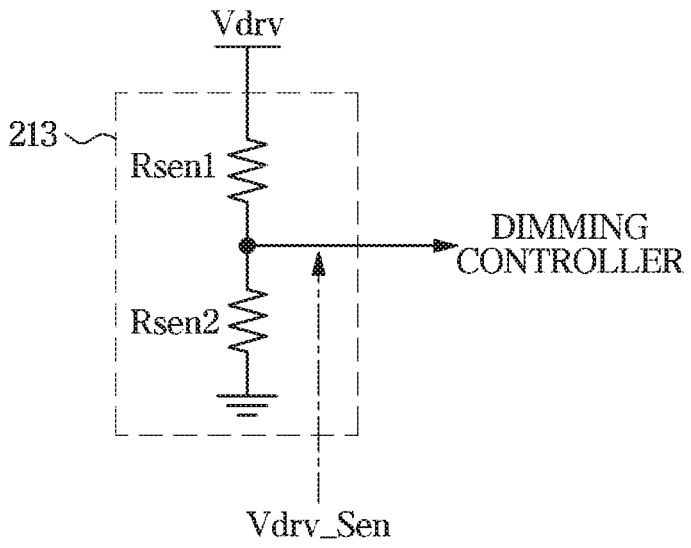
FIG. 9 is a circuit diagram illustrating a first voltage sensor illustrated in FIG. 8 according to an embodiment.

FIG. 8 is a circuit diagram illustrating another example of a backlight unit of a display apparatus according to an embodiment, and FIG. 9 is a circuit diagram illustrating an example first voltage sensor illustrated in FIG. 8 according to an embodiment.

Referring to FIGS. 8 and 9, the backlight unit 200 may include the plurality of light emitting diodes LED1 to LED8, the plurality of driving switches M1 to M8, and the plurality of shunt resistors R1 to R8. The plurality of light emitting diodes LED1 to LED8, the plurality of driving switches M1 to M8, and the plurality of shunt resistors R1 to R8 may be the same as or similar to those illustrated in FIG. 3.

The backlight unit 200 may include a first voltage sensor 213 for detecting the driving voltage Vdrv output from the power supply 130, a second voltage sensor 214 for detecting the first feedback signal FB0 of the dimming driver 212, the dimming driver 212 for controlling the driving current of the plurality of light emitting diodes LED1 to LED8, and the dimming controller 211 for controlling the dimming driver 212.

The first voltage sensor 213 may be implemented as the resistance network. For example, as illustrated in FIG. 9, the first voltage sensor 213 may be implemented as a voltage distribution circuit including a first detection resistor RSEN1 and a second detection resistor RSEN2.

The first detection resistor RSEN1 may be connected in series with the second detection resistor RSEN2. The first detection resistor RSEN1 may be connected to the power supply 130, and the second detection resistor RSEN2 may be connected to a ground. The driving voltage Vdrv may be applied to both the first detection resistor RSEN1 and the second detection resistor RSEN2 connected in series with each other. A driving voltage level Vdrv_sen may be output from a node to which the first detection resistor RSEN1 and the second detection resistor RSEN2 are connected.

The first voltage sensor 213 may detect the driving voltage Vdrv output from the power supply 130 and output the driving voltage level Vdrv_sen to the dimming controller 211 depending on the detected driving voltage Vdrv.

The second voltage sensor 214 may detect the first feedback signal FB0 output from the dimming driver 212 and output a first feedback level FB0_sen to the dimming controller 211 depending on the detected first feedback signal FB0.

The second voltage sensor 214 may be implemented as the voltage distribution circuit similar to the first voltage sensor 213.

The dimming controller 211 may determine the driving voltage Vdrv and the first feedback signal FB0 based on the driving voltage level Vdrv_sen of the first voltage sensor 213 and the first feedback level FB0_sen of the second voltage sensor 214. Also, the dimming controller 211 may identify whether an overvoltage is applied to the driving switches M1 to M8 based on the driving voltage Vdrv and the first feedback signal FB0.

Figure 10:
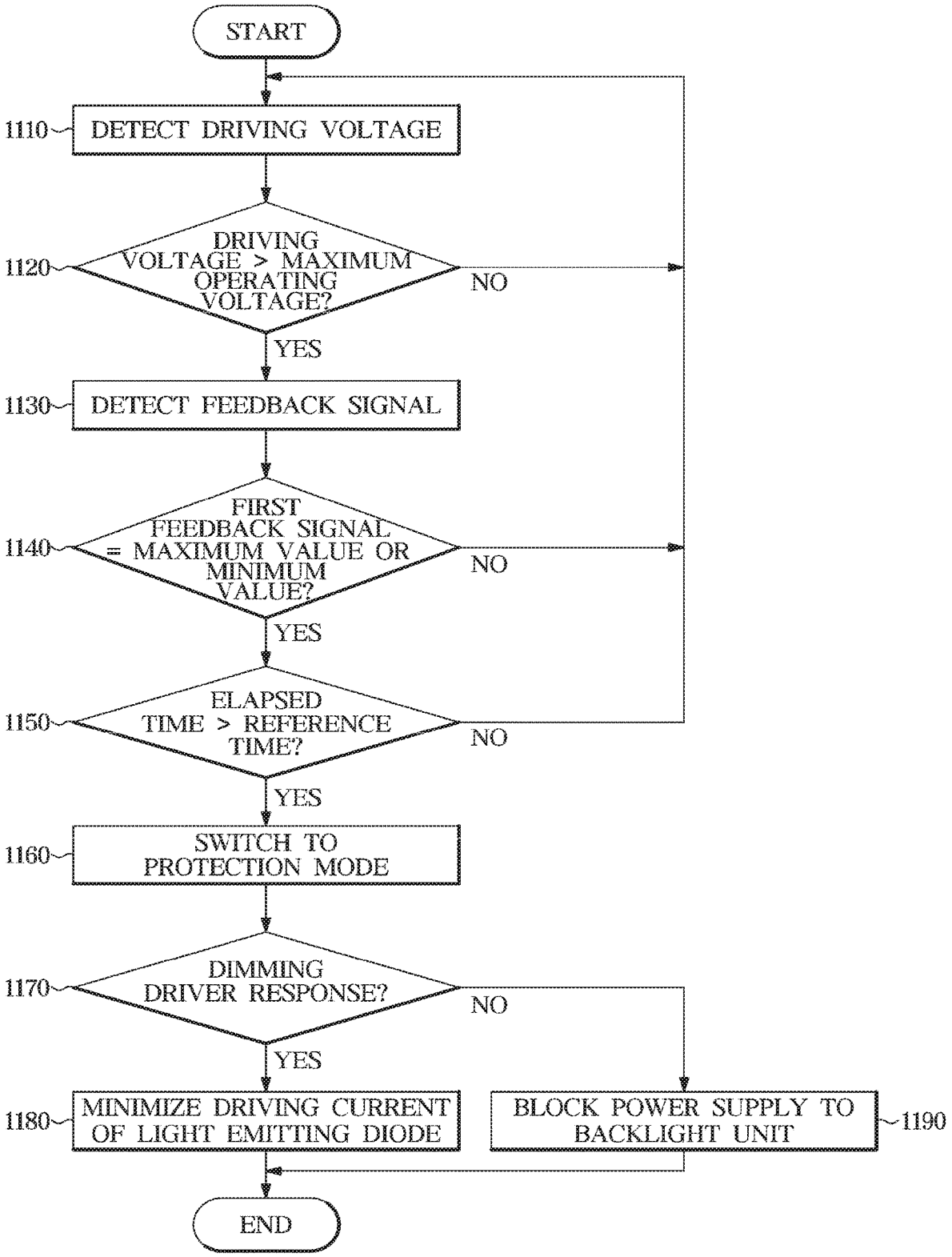
FIG. 10 is a flowchart illustrating an example operation of a dimming controller illustrated in FIG. 8 according to an embodiment.

FIG. 10 is a flowchart illustrating an example operation of a dimming controller illustrated in FIG. 8 according to an embodiment.

As illustrated in FIG. 10, the dimming controller 211 may detect the driving voltage Vdrv (1110).

The dimming controller 211 may operate in a normal mode. In the normal mode, the dimming controller 211 may receive the dimming data for local dimming from the processor 160 and determine the value of the current reference Idrv* to be supplied to the plurality of light emitting diodes LED1 to LED8 based on the dimming data. Also, the dimming controller 211 may transmit values of the current reference Idrv* determined based on the dimming data to the dimming driver 212.

In addition, in the normal mode, the dimming controller 211 may detect the driving voltage Vdrv output from the power supply 130 through the first voltage sensor 213.

The dimming controller 211 may determine whether the driving voltage Vdrv is greater than the maximum operating voltage (1120).

The dimming controller 211 may compare the driving voltage Vdrv with the maximum operating voltage. The maximum operating voltage may represent a maximum value of the voltage for the plurality of light emitting diodes LED1 to LED8 of the backlight unit 200 to operate normally.

When the driving voltage Vdrv is not greater than the maximum operating voltage (NO in 1120), the dimming controller 211 may detect the driving voltage Vdrv again.

When the driving voltage Vdrv is greater than the maximum operating voltage (YES in 1120), the dimming controller 211 may detect the first feedback signal FB0 (1130).

The dimming controller 211 may detect the first feedback signal FB0 output from the dimming driver 212 through the second voltage sensor 214.

The dimming controller 211 detecting the first feedback signal FB0 is not limited to the dimming controller 211 detecting the first feedback signal FB0 through the second voltage sensor 214. For example, the dimming controller 211 may receive information about the first feedback signal FB0 from the dimming driver 212.

The dimming controller 211 may determine whether the first feedback signal FB0 is substantially equal to a maximum allowable value or substantially equal to a minimum allowable value (1140).

The first feedback signal FB0 may be limited to a predetermined voltage range.

The dimming controller 211 may compare the first feedback signal FB0 with the minimum allowable value, and also compare the first feedback signal FB0 with the maximum allowable value.

When the first feedback signal FB0 is different from both the minimum allowable value and the maximum allowable value (NO in 1140), the dimming controller 211 may determine that the driving voltage Vdrv temporarily exceeds the maximum operating voltage depending on the first feedback signal FB0. In addition, the dimming controller 211 may determine that the driving voltage Vdrv is controlled by the dimming driver 212.

Therefore, the dimming controller 211 may still operate in the normal mode and detect the driving voltage Vdrv again.

When the first feedback signal FB0 is substantially equal to the maximum allowable value or substantially equal to the minimum allowable value (YES in 1140), the dimming controller 211 may determine whether an elapsed time is greater than a reference time (1150).

The dimming controller 211 may count the elapsed time while the driving voltage Vdrv exceeds the maximum operating voltage and the first feedback signal FB0 is substantially equal to the maximum allowable value or the minimum allowable value.

The dimming controller 211 may compare the counted time with the reference time. The reference time may refer, for example, to a time at which the driving voltage Vdrv exceeding the maximum operating voltage is allowed.

When the elapsed time is not greater than the reference time (NO in 1150), the dimming controller 211 may determine that a time when the driving voltage Vdrv exceeds the maximum operating voltage is within an allowable time.

Therefore, the dimming controller 211 may still operate in the normal mode and detect the driving voltage Vdrv again.

When the elapsed time is greater than the reference time (YES in 1150), the dimming controller 211 may switch to a protection mode (1160) and determine whether the dimming driver 212 responds (1170).

When the driving voltage Vdrv exceeds the maximum operating voltage and the time that the first feedback signal FB0 is substantially equal to the maximum allowable value or the minimum allowable value is greater than the reference time, the dimming controller 211 may determine that the driving voltage Vdrv exceeds the maximum operating voltage due to a malfunction of the dimming driver 212 and/or a malfunction of the power supply 130.

The dimming controller 211 may switch an operation mode from the normal mode to the protection mode to prevent and/or reduce overheating of the light emitting diodes LED1 to LED8 and/or the driving switches M1 to M8.

In the protection mode, the dimming controller 211 may transmit a signal (or message) requesting a response to the dimming driver 212 to determine whether the dimming driver 212 is malfunctioning. Thereafter, the dimming controller 211 may determine whether to receive a response signal (or response message) from the dimming driver 212 within a predetermined time.

When the dimming driver 212 responds (YES in 1170), the dimming controller 211 may minimize and/or reduce the driving current of the light emitting diodes LED1 to LED8 (1180).

In the protection mode, the dimming controller 211 may control the dimming driver 212 to minimize the driving current of the light emitting diodes LED1 to LED8. The dimming controller 211 may transmit the decreased current reference Idrv* to the dimming driver 212 to decrease the driving voltage Vdrv.

The dimming driver 212 may receive the decreased current reference Idrv* and control the plurality of driving switches M1 to M8 to supply the decreased current reference Idrv* to the plurality of light emitting diodes LED1 to LED8.

Further, the dimming driver 212 may output the first feedback signal FB0 for adjusting the driving voltage Vdrv to the power supply 130 depending on the decreased current reference Idrv*.

The power supply 130 may decrease the driving voltage Vdrv in response to the first feedback signal FB0 depending on the decreased current reference Idrv*. Accordingly, overheating of the light emitting diodes LED1 to LED8 and/or the driving switches M1 to M8 may be prevented and/or reduced.

When the dimming driver 212 does not respond (NO in 1170), the dimming controller 211 may block the power supply to the backlight unit 200 (1190).

When the dimming driver 212 does not respond, the dimming controller 211 may determine the malfunction of the dimming driver 212.

The dimming controller 211 may transmit a power control signal Power_ctrl for stopping the power supply to the backlight unit 200 to the power supply 130.

The power controller 311 may control the power driver 321 to stop the power supply to the backlight unit 200 in response to the power control signal Power_ctrl of the dimming controller 211. Thereby, overheating of the light emitting diodes LED1 to LED8 and/or the driving switches M1 to M8 may be prevented and/or reduced.

When the predetermined time elapses after the power supply to the backlight unit 200 is cut off, the dimming controller 211 may transmit the power control signal Power_ctrl for allowing the power supply to the backlight unit 200 to the power supply 130. The power controller 311 may control the power driver 321 to allow the power supply to the backlight unit 200 in response to the power control signal Power_ctrl of the dimming controller 211.

As described above, the display apparatus 100 may determine the overvoltage of the backlight unit 200 depending on the driving voltage Vdrv supplied to the backlight unit 200 and the first feedback signal FB0 of the backlight unit 200. Accordingly, the display apparatus 100 may prevent and/or reduce overheating of the light emitting diodes LED1 to LED8 and/or the driving switches M1 to M8.

Figure 11:
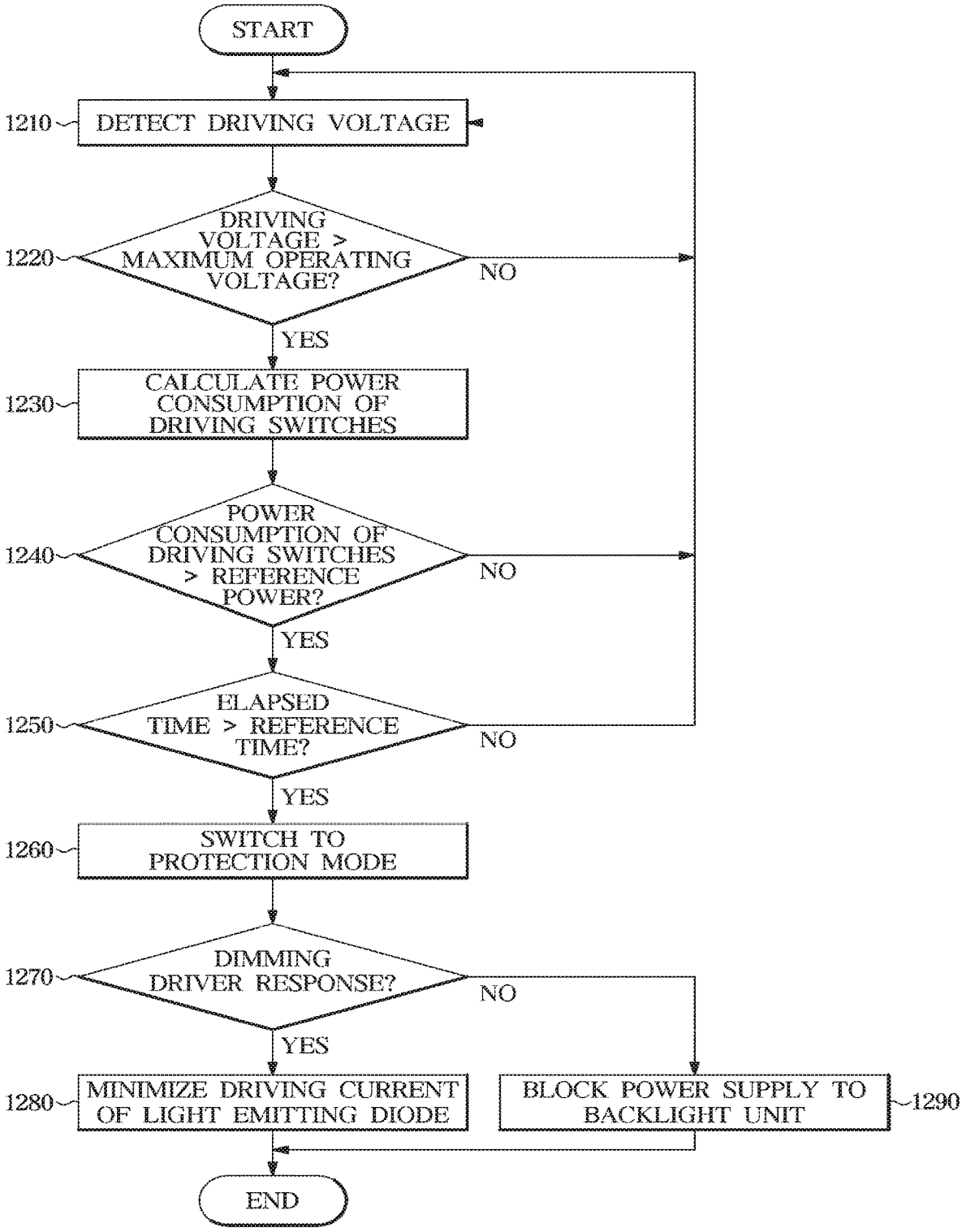
FIG. 11 is a flowchart illustrating another example operation of a dimming controller illustrated in FIG. 8 according to an embodiment.

FIG. 11 is a flowchart illustrating another example operation of a dimming controller illustrated in FIG. 8 according to an embodiment.

As illustrated in FIG. 11, the dimming controller 211 may detect the driving voltage Vdrv (1210). Thereafter, the dimming controller 211 may determine whether the driving voltage Vdrv is greater than the maximum operating voltage (1220).

Operations 1210 and 1220 may be the same as or similar to operations 1110 and 1120 illustrated in FIG. 10, respectively.

When the driving voltage Vdrv is greater than the maximum operating voltage (YES in 1220), the dimming controller 211 may calculate the power consumption of the plurality of driving switches M1 to M8 (1230).

The power consumption of the driving switch may, for example, be calculated as the product of the current flowing through the driving switch and the voltage applied to the driving switch.

The dimming controller 211 may determine the power consumption of the driving switches M1 to M8 based on the detected driving voltage Vdrv and the current reference Idrv*. For example, the dimming controller 211 may calculate the product of the difference between the detected driving voltage Vdrv and the voltage drop of the light emitting diodes LED1 to LED8 and the current reference Idrv*.

The dimming controller 211 may determine whether the power consumption of the driving switches M1 to M8 is greater than the reference power (1240).

The power consumption of the driving switches M1 to M8 may be converted into heat energy, and a temperature of the driving switches M1 to M8 may increase. In addition, the temperature of the driving switches M1 to M8 may be lowered by discharging heat energy to the surroundings.

When the power consumption of the driving switches M1 to M8 is greater than a reference power, the heat energy generated by the power consumption may be greater than the heat energy emitted, thereby overheating the driving switches M1 to M8.

To prevent and/or avoid this, the dimming controller 211 may compare the power consumption of the driving switches M1 to M8 and the reference power.

When the power consumption of the driving switches M1 to M8 is not greater than the reference power (NO in 1240), the dimming controller 211 may still operate in the normal mode and detect the driving voltage Vdrv again.

When the power consumption of the driving switches M1 to M8 is greater than the reference power (YES in 1240), the dimming controller 211 may determine whether the elapsed time is greater than the reference time (1250). When the elapsed time is greater than the reference time (YES in 1250), the dimming controller 211 may switch to the protection mode (1260) and determine whether the dimming driver 212 responds (1270). When the dimming driver 212 responds (YES in 1270), the dimming controller 211 may minimize and/or reduce the driving current of the light emitting diodes LED1 to LED8 (1280). Further, when the dimming driver 212 does not respond (NO in 1270), the dimming controller 211 may cut off (e.g., block) the power supply to the backlight unit 200 (1290).

Operations 1250, 1260, 1270, 1280, and 1290 may be the same as or similar to operations 1150, 1160, 1170, 1180, and 1190 illustrated in FIG. 10, respectively.

As described above, the display apparatus 100 may determine the overvoltage of the backlight unit 200 depending on the driving voltage Vdrv supplied to the backlight unit 200 and the power consumption of the backlight unit 200. Accordingly, the display apparatus 100 may prevent and/or reduce overheating of the light emitting diodes LED1 to LED8 and/or the driving switches M1 to M8.

Figure 12:
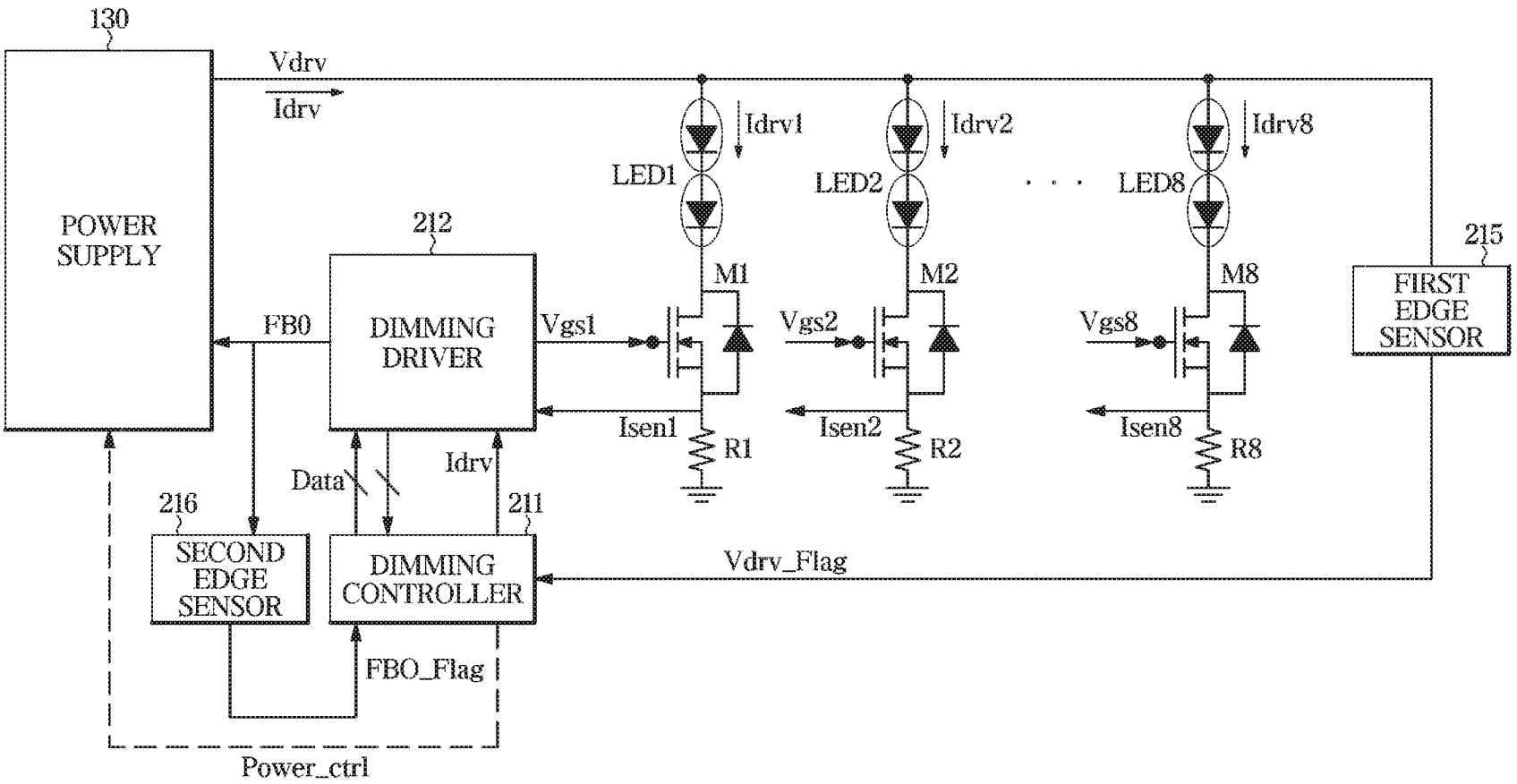
FIG. 12 is a circuit diagram illustrating another example of a backlight unit of a display apparatus according to an embodiment.
Figure 13:
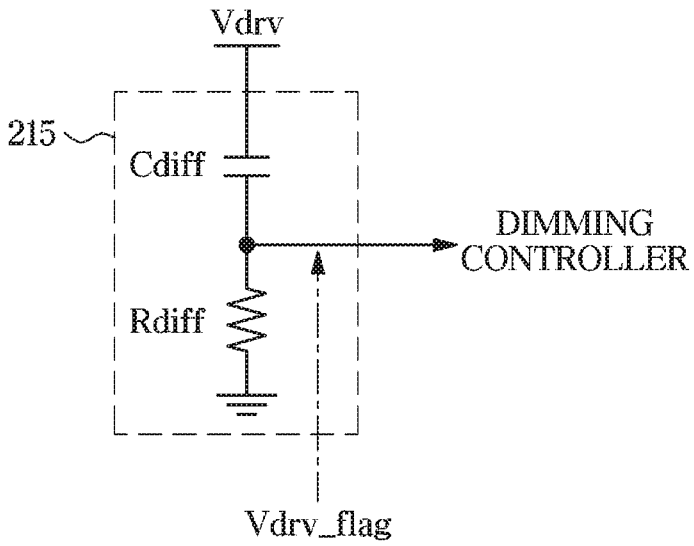
FIG. 13 is a circuit diagram illustrating a first edge sensor illustrated in FIG. 12 according to an embodiment.
Figure 14:
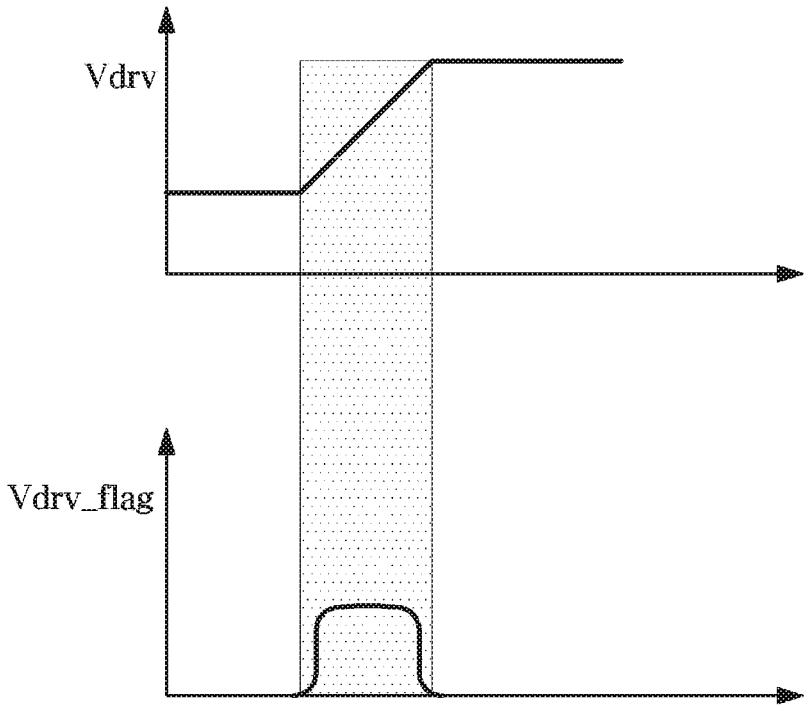
FIG. 14 are graphs illustrating an output of a first edge sensor illustrated in FIG. 12 according to an embodiment.

FIG. 12 is a circuit diagram illustrating another example of a backlight unit of a display apparatus according to an embodiment, FIG. 13 is a circuit diagram illustrating a first edge sensor illustrated in FIG. 12 according to an embodiment, and FIG. 14 includes graphs illustrating an output of a first edge sensor illustrated in FIG. 12 according to an embodiment.

Referring to FIGS. 12 to 14, the backlight unit 200 may include the plurality of light emitting diodes LED1 to LED8, the plurality of driving switches M1 to M8, and the plurality of shunt resistors R1 to R8. The plurality of light emitting diodes LED1 to LED8, the plurality of driving switches M1 to M8, and the plurality of shunt resistors R1 to R8 may be the same as or similar to those illustrated in FIG. 3.

The backlight unit 200 may include a first edge sensor 215 for detecting a change in the driving voltage Vdrv output from the power supply 130, a second edge sensor 216 for detecting a change in the first feedback sensor FB0 of the dimming driver 212, the dimming driver 212 for controlling the driving current of the backlight unit 200, and the dimming controller 211 for controlling the dimming driver 212.

The first edge sensor 215 may be implemented as a differential circuit.

For example, as illustrated in FIG. 13, the first edge sensor 215 may be implemented as the differential circuit including a differential capacitor Cdiff and a differential resistor Rdiff.

The differential capacitor Cdiff may be connected in series with the differential resistor Rdiff. The differential capacitor Cdiff may be connected to the power supply 130 and the differential resistor Rdiff may be connected to a ground. The driving voltage Vdrv may be applied to both the differential capacitor Cdiff and the differential resistor Rdiff connected in series with each other. A driving voltage flag Vdrv_flag may be output from a node to which the differential capacitor Cdiff and the differential resistor Rdiff are connected.

The first edge sensor 215 may detect the change in the driving voltage Vdrv output from the power supply 130 and output the driving voltage flag Vdrv_flag to the dimming controller 211 depending on the detected change in the driving voltage Vdrv.

For example, as illustrated in FIG. 14, while the driving voltage Vdrv increases, a current passing through the differential capacitor Cdiff flows, and the current passing through the differential capacitor Cdiff also flows through the differential resistor Rdiff. Due to the current passing through the differential resistor Rdiff, a voltage drop occurs across the differential resistor Rdiff. Due to the voltage drop of the differential resistor Rdiff, the driving voltage flag Vdrv_flag in a substantially pulse form may be output from the node to which the differential capacitor Cdiff and the differential resistor Rdiff are connected, as illustrated in FIG. 14.

The second edge sensor 216 may detect the change in the first feedback signal FB0 output from the dimming driver 212, and output a feedback flag FB0_flag to the dimming controller 211 depending on the detected first feedback signal FB0.

The second edge sensor 216 may be implemented as the differential circuit similar to the first edge sensor 215.

The dimming controller 211 may determine the change in the driving voltage Vdrv and the change in the first feedback signal FB0 based on the driving voltage flag Vdrv_flag of the first edge sensor 215 and the feedback flag FB0_flag of the second edge sensor 216. In addition, the dimming controller 211 may identify whether the overvoltage is applied to the driving switches M1 to M8 of the backlight unit 200 based on the change in the driving voltage Vdrv and the change in the first feedback signal FB0.

Figure 15:
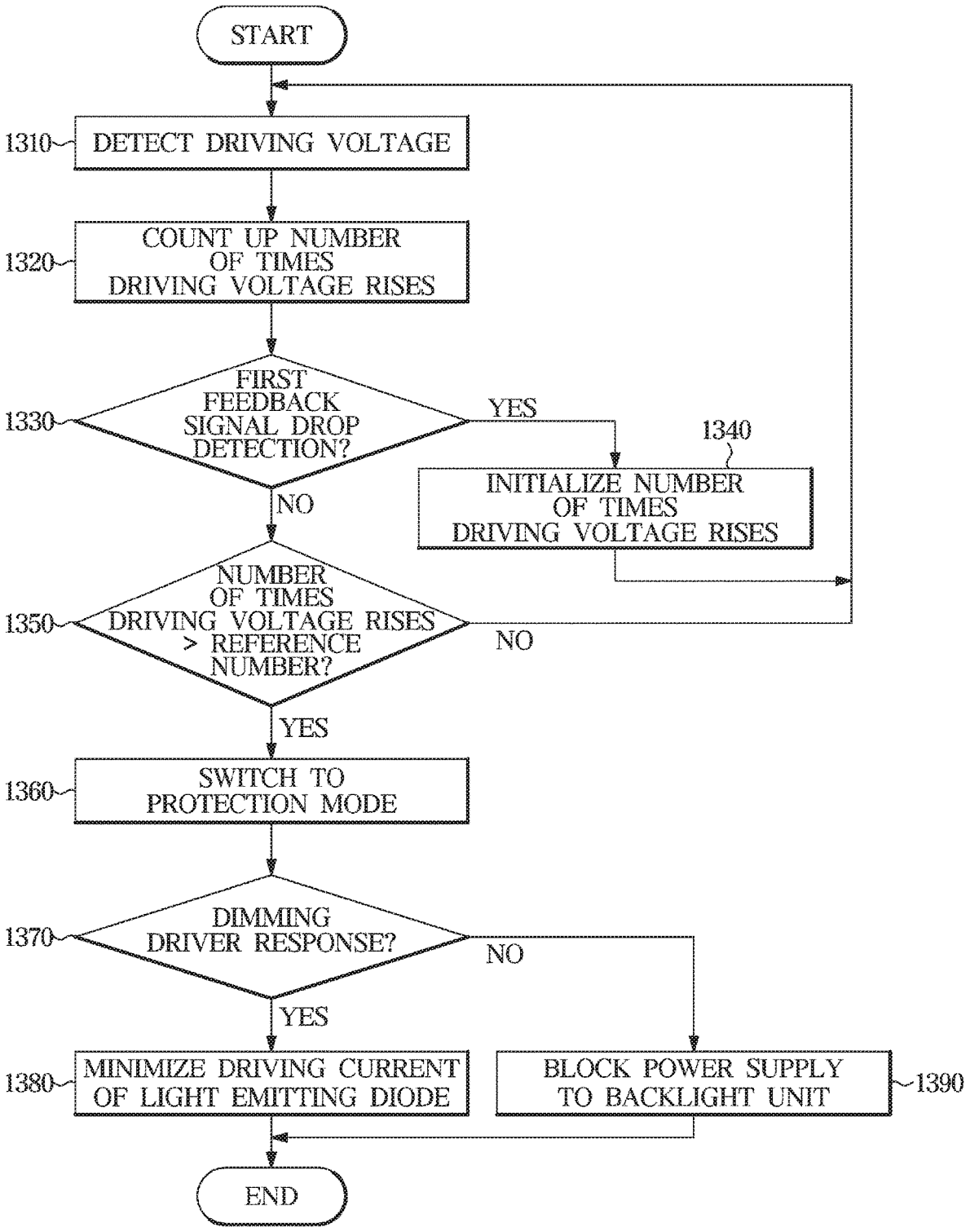
FIG. 15 is a flowchart illustrating an example operation of a dimming controller illustrated in FIG. 12 according to an embodiment.

FIG. 15 is a flowchart illustrating an example operation of a dimming controller illustrated in FIG. 12 according to an embodiment.

As illustrated in FIG. 15, the dimming controller 211 may detect an increase in the driving voltage Vdrv (1310).

The dimming controller 211 may detect the increase in the driving voltage Vdrv output from the power supply 130 through the first edge sensor 215 in the normal mode.

The first edge sensor 215 may output the driving voltage flag Vdrv_flag in the substantially pulse form in response to the increase in the driving voltage Vdrv. Accordingly, the dimming controller 211 may determine the increase in the driving signal Vdrv based on whether the driving voltage flag Vdrv_flag is detected.

In addition, the dimming controller 211 may distinguish the increase in the driving voltage Vdrv from noise based on a magnitude of the driving voltage flag Vdrv_flag. For example, when the driving voltage flag Vdrv_flag is greater than a reference value, the dimming controller 211 may determine the increase in the driving voltage Vdrv. Also, when the driving voltage flag Vdrv_flag is not greater than the reference value, the dimming controller 211 may determine the driving voltage flag Vdrv_flag due to noise.

After detecting the increase in the driving voltage Vdrv, the dimming controller 211 may count up the number of times the driving voltage Vdrv rises (1320).

The first edge sensor 215 may be implemented with the differential circuit, and the feedback flag FB0_flag may indicate the increase in the driving voltage Vdrv. Therefore, the magnitude of the increase in the driving voltage Vdrv may be related to the time when the rise of the driving voltage Vdrv is detected, that is, the time when the feedback flag FB0_flag is detected.

In order to determine the magnitude of the increase in the driving voltage Vdrv, when the feedback flag FB0_flag is received, the dimming controller 211 may count up the number of times the driving voltage Vdrv rises.

The dimming controller 211 may determine whether the first feedback signal FB0 changes (1330).

The dimming controller 211 may detect the change in the first feedback signal FB0 output from the dimming driver 212 through the detected second edge sensor 216.

The second edge sensor 216 may output the feedback flag FB0_flag in the form of the pulse in response to the change in the first feedback signal FB0. Accordingly, the dimming controller 211 may determine the change in the first feedback signal FB0 based on whether the feedback flag FB0_flag is detected.

In addition, the dimming controller 211 may distinguish the change in the feedback flag FB0_flag from noise based on the magnitude of the feedback flag FB0_flag.

When the change in the first feedback signal FB0 is detected (YES in 1330), the dimming controller 211 may initialize the number of times the driving voltage Vdrv rises (1340).

As described above, the dimming driver 212 may output the first feedback signal FB0 for changing the driving voltage Vdrv. Accordingly, when the change in the first feedback signal FB0 is detected along with the increase in the driving voltage Vdrv, the dimming controller 211 may determine that the driving voltage Vdrv is increased due to the change in the first feedback signal FB0.

The dimming controller 211 may determine that the increase in the driving voltage Vdrv is due to normal operation of the dimming driver 212. Accordingly, the dimming controller 211 may initialize the number of times the driving voltage Vdrv rises, which indicates an abnormal rise in the driving voltage Vdrv. Also, the dimming controller 211 may detect the increase in the driving voltage Vdrv again.

When the change in the first feedback signal FB0 is not detected (NO in 1330), the dimming controller 211 may determine whether the number of rises of the driving voltage Vdrv is greater than the reference number (1350).

The dimming controller 211 may periodically detect the increase in the driving voltage Vdrv every predetermined time. In addition, the dimming controller 211 may count up the number of times the driving voltage Vdrv rises whenever the driving voltage Vdrv rise is detected. Accordingly, the number of times the driving voltage Vdrv rises may indicate the magnitude of the increase in the driving voltage Vdrv.

The dimming controller 211 may compare the number of times the driving voltage Vdrv rises with the reference number to determine whether the magnitude of the increase of the driving voltage Vdrv is greater than the predetermined reference voltage.

When the number of times the driving voltage Vdrv rises is not greater than the reference number (NO in 1350), the dimming controller 211 may detect the increase of the driving voltage Vdrv again.

When the number of times the driving voltage Vdrv rises is greater than the reference number (YES in 1350), the dimming controller 211 may switch to the protection mode (1360) and determine whether the dimming driver 212 responds (1370). When the dimming driver 212 responds (YES in 1370), the dimming controller 211 may minimize and/or reduce the driving current of the light emitting diodes LED1 to LED8 (1380). Further, when the dimming driver 212 does not respond (NO in 1370), the dimming controller 211 may cut off (e.g., block) the power supply to the backlight unit 200 (1390).

Operations 1360, 1370, 1380, and 1390 may be the same as or similar to operations 1160, 1170, 1180, and 1190 illustrated in FIG. 10, respectively.

As described above, the display apparatus 100 may determine the overvoltage of the backlight unit 200 depending on the increase in the driving voltage Vdrv supplied to the backlight unit 200 and the change in the first feedback signal FB0 of the backlight unit 200. Accordingly, the display apparatus 100 may prevent and/or reduce overheating of the light emitting diodes LED1 to LED8 and/or the driving switches M1 to M8.

Figure 16:
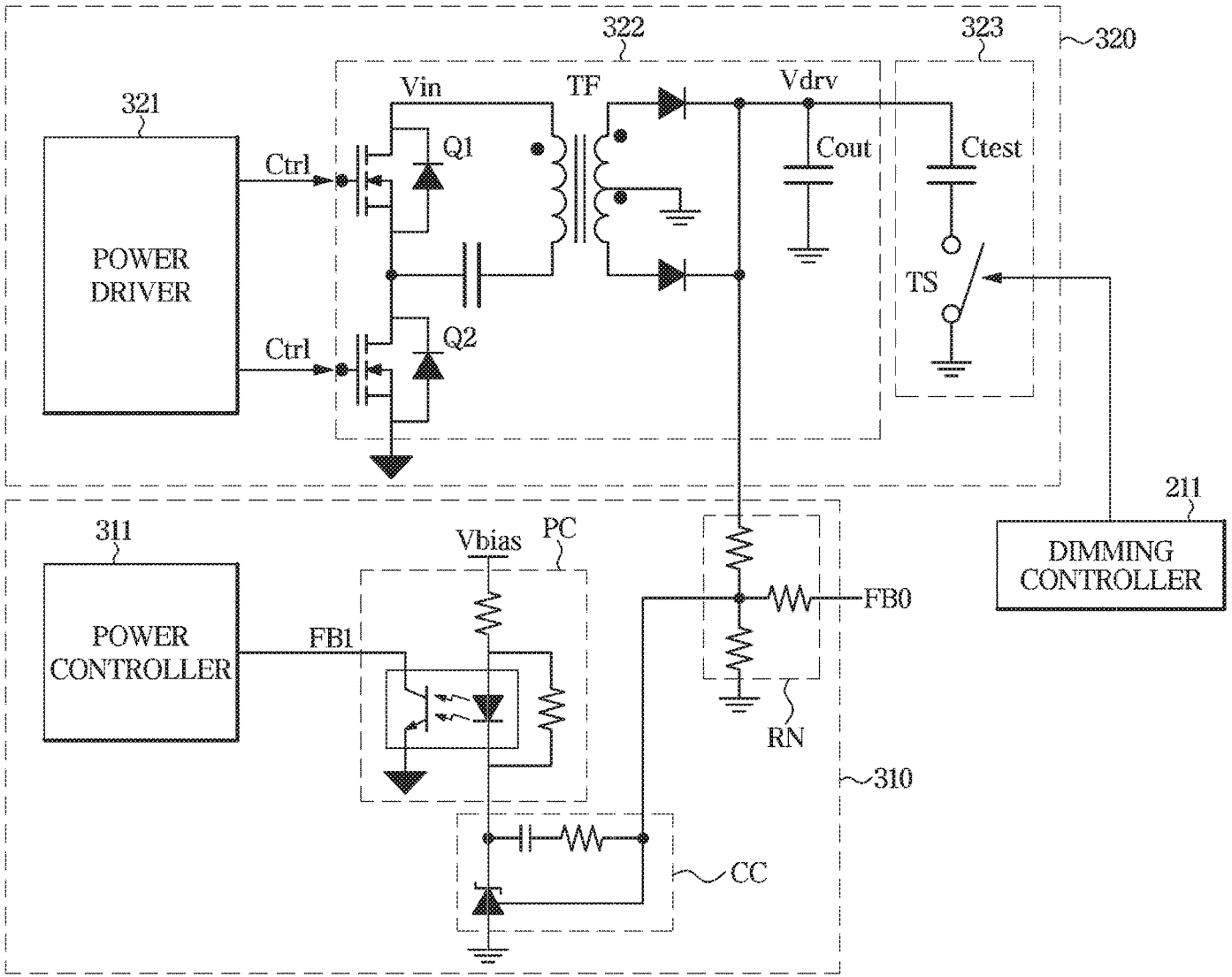
FIG. 16 is a circuit diagram illustrating another example of a power supply of a display apparatus according to an embodiment.

FIG. 16 is a circuit diagram illustrating another example of a power supply of a display apparatus according to an embodiment.

Referring to FIG. 16, the power supply 130 may include the power supply circuit 320 and the power control circuit 310. The power supply circuit 320 may include the DC-DC conversion circuit 322 and the power driver 321. The power control circuit 310 may include the power controller 311. The DC-DC conversion circuit 322, the power driver 321, and the power controller 311 may be the same as or similar to the DC-DC conversion circuit 322, the power driver 321, and the power controller 311 illustrated in FIG. 6.

The power supply circuit 320 may further include a test circuit 323 capable of diagnosing the DC-DC conversion circuit 322.

The test circuit 323 may include a test capacitor Ctest that operates as a test load for testing the DC-DC conversion circuit 322, and a test switch TS that activates or deactivates the test capacitor Ctest.

The test capacitor Ctest may be connected in parallel with the output capacitor Cout of the DC-DC conversion circuit 322 as illustrated in FIG. 16. In order to secure the reliability of self-diagnosis, a capacitance of the test capacitor Ctest may be greater than a capacitance of the output capacitor Cout. When the capacitance of the test capacitor Ctest is the same as or similar to that of the output capacitor Cout, it may be difficult to dynamically change the driving voltage Vdrv.

The test switch TS may be connected in series with the test capacitor Ctest. For example, the test switch TS may be provided between the test capacitor Ctest and a ground. The test switch TS may be controlled by the dimming controller 211.

The dimming controller 211 may self-diagnose the driving voltage Vdrv. For example, the dimming controller 211 may control the dimming driver 212 to turn on the test switch TS and output the first feedback signal FB0. The dimming controller 211 may detect the change in the driving voltage Vdrv depending on the change in the first feedback signal FB0. The dimming controller 211 may determine whether the power supply 130 is malfunctioning based on whether the change in the driving voltage Vdrv is detected.

Figure 17:
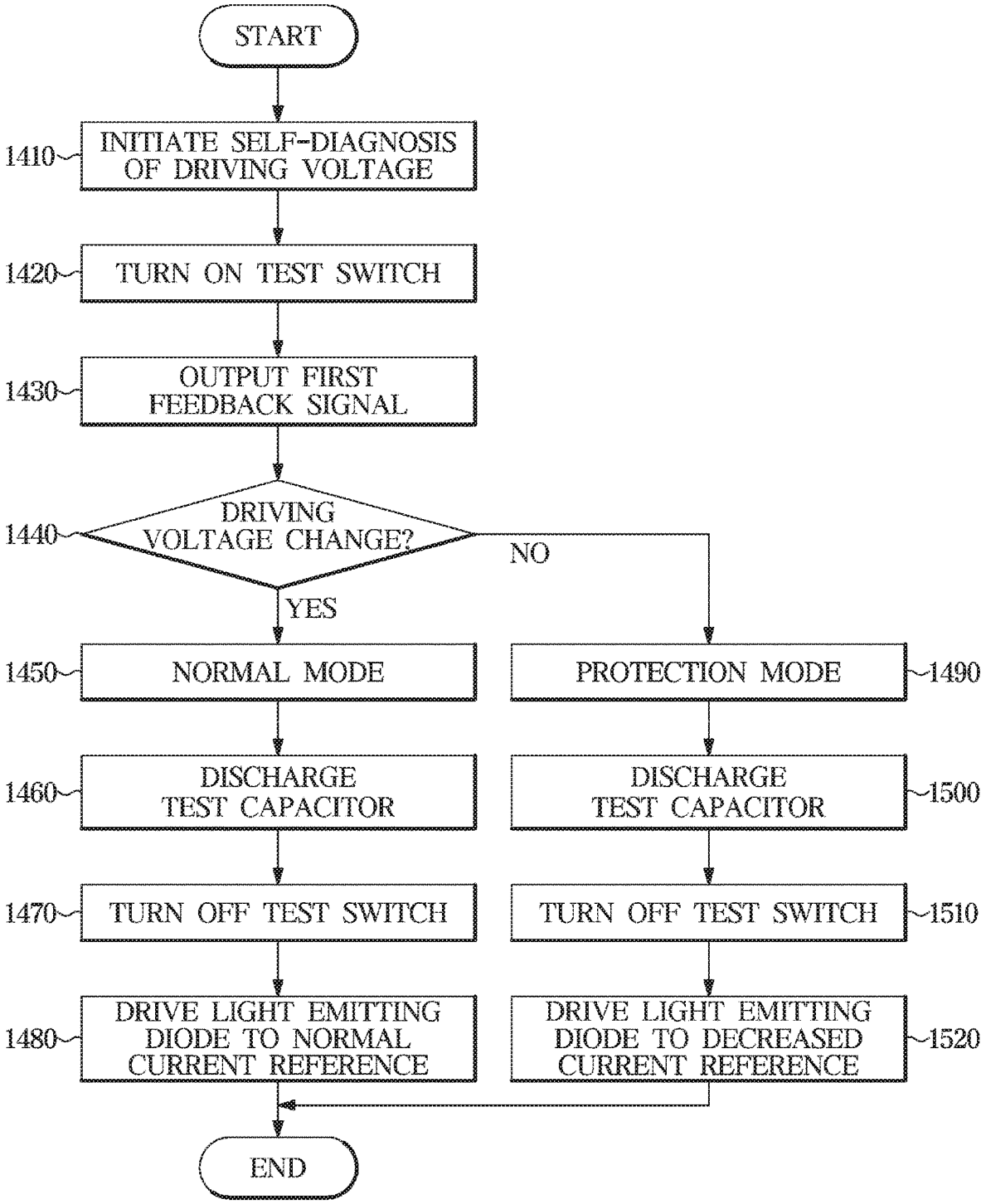
FIG. 17 is a flowchart illustrating an example operation of a dimming controller illustrated in FIG. 16 according to an embodiment.

FIG. 17 is a flowchart illustrating an example operation of a dimming controller illustrated in FIG. 16 according to an embodiment.

As illustrated in FIG. 17, the dimming controller 211 may initiate self-diagnosis of the driving voltage Vdrv (1410).

In response to receiving an operation command from the user, the dimming controller 211 may self-diagnose the power supply 130 that supplies the driving voltage Vdrv to the backlight unit 200. For example, the dimming controller 211 may self-diagnose the power supply 130 before applying the driving voltage Vdrv to the backlight unit 200 after the user's operation command is received.

The dimming controller 211 may turn on the test switch TS (1420).

The dimming controller 211 may turn on the test switch TS to activate the test capacitor Ctest.

Due to the turn-on of the test switch TS, a current path may be generated from the DC-DC conversion circuit 322 to the ground through the test capacitor Ctest, and the test capacitor Ctest may be activated.

The dimming controller 211 may control the dimming driver 212 to output the feedback signal to the power supply 130 (1430).

The dimming controller 211 may control the dimming driver 212 to output the first feedback signal FB0 for controlling the power supply 130 to the power supply 130.

For example, the dimming controller 211 may control the dimming driver 212 to output the first feedback signal FB0 sequentially increasing. Alternatively, the dimming controller 211 may control the dimming driver 212 to output the first feedback signal FB0 sequentially decreasing.

In addition, the dimming controller 211 may previously store a lookup table including the driving voltage Vdrv corresponding to the first feedback signal FB0 and the first feedback signal FB0. The dimming controller 211 may control the dimming driver 212 to output the arbitrary first feedback signal FB0 with reference to the lookup table.

The dimming controller 211 may determine whether the driving voltage Vdrv changes in response to the change of the first feedback signal FB0 (1440).

During the normal operation, the power supply 130 may change the driving voltage Vdrv in response to the change in the first feedback signal FB0, and the dimming controller 211 may detect the change in the driving voltage Vdrv.

The dimming controller 211 may detect the driving voltage Vdrv through the first voltage sensor 213 (see FIG. 8) while controlling the dimming driver 212 to change the first feedback signal FB0. While the dimming controller 211 controls the dimming driver 212 to change the first feedback signal FB0, the dimming controller 211 may detect the change in the driving voltage Vdrv through the first edge sensor 215 (see FIG. 12).

When the driving voltage Vdrv changes in response to the change of the first feedback signal FB0 (YES in 1440), the dimming controller 211 may operate in the normal mode (1450).

When the driving voltage Vdrv changes in response to the change in the first feedback signal FB0, the dimming controller 211 may determine that the power supply 130 operates normally. Therefore, the dimming controller 211 may operate in the normal mode in which the backlight unit 200 is normally operated.

In the normal mode, the dimming controller 211 may discharge the test load, that is, the test capacitor Ctest (1460), and turn off the test switch TS (1470).

After the self-diagnosis of the driving voltage Vdrv ends, the dimming controller 211 may deactivate the test capacitor Ctest. The dimming controller 211 may discharge the test capacitor Ctest prior to deactivation of the test capacitor Ctest, and turn off the test switch TS to deactivate the test capacitor Ctest.

The dimming controller 211 may drive the light emitting diodes LED1 to LED8 to the normal current reference Idrv* (1480).

In the normal mode, the dimming controller 211 may control the dimming driver 212 to normally drive the backlight unit 200. For example, the dimming controller 211 may receive dimming data for local dimming from the processor 160, and control the dimming driver 212 so that the driving current Idrv of the backlight unit 200 follows the normal current reference Idrv* based on the dimming data.

When the driving voltage Vdrv does not change in response to the change in the first feedback signal FB0 (NO in 1440), the dimming controller 211 may operate in the protection mode (1490).

When the driving voltage Vdrv does not change in response to the change in the first feedback signal FB0, the dimming controller 211 may determine that the power supply 130 operates abnormally. Accordingly, the dimming controller 211 may operate in the protection mode for protecting the backlight unit 200 from overvoltage/overcurrent/overheating.

In the protection mode, the dimming controller 211 may discharge the test load, that is, the test capacitor Ctest (1500), and turn off the test switch TS (1510).

The dimming controller 211 may discharge the test capacitor Ctest and turn off the test switch TS to deactivate the test capacitor Ctest.

The dimming controller 211 may drive the light emitting diodes LED1 to LED8 to the decreased current reference Idrv* (1520).

In the protection mode, the dimming controller 211 may decrease the current reference Idrv* to protect the backlight unit 200 from overvoltage/overcurrent/overheating. The dimming controller 211 may control the dimming driver 212 to drive the backlight unit 200 with the decreased current reference Idrv*. For example, the dimming controller 211 may receive the dimming data for local dimming from the processor 160, and control the dimming driver 212 so that the driving current Idrv of the backlight unit 200 follows the decreased current reference Idrv* based on the dimming data.

As described above, the display apparatus 100 may self-diagnose the power supply 130. The display apparatus 100 may decrease the driving current of the backlight unit 200 when the malfunction of the power supply 130 is detected. Accordingly, damage to the driving switches M1 to M8 and/or the light emitting diodes LED1 to LED of the backlight unit 200 may be prevented and/or reduced.

According to an example embodiment, the display apparatus may include: a light emitting diode; a power supply configured to apply a driving voltage and supply a driving current to the light emitting diode; a driving switch configured to control the driving current of the light emitting diode; a voltage sensor configured to detect the driving voltage; and a driving controller configured to control the driving switch so that the driving current of the light emitting diode follows a current reference. The driving controller may be configured to decrease the current reference to decrease the driving current of the light emitting diode in response to the driving voltage detected by the voltage sensor being greater than a predetermined voltage.

The display apparatus may prevent and/or reduce overheating of the light emitting diode and/or the driving switch by preventing and/or reducing an overvoltage from being applied to the light emitting diode.

The driving controller may be configured to decrease the current reference to decrease the driving current of the light emitting diode in response to a time in which the detected driving voltage is greater than the predetermined voltage is greater than a reference time.

The display apparatus may prevent and/or reduce overheating of the light emitting diode and/or the driving switch by preventing and/or reducing the overvoltage of the light emitting diode from being continuously applied.

The driving controller may be configured to transmit a feedback signal for adjusting the driving voltage based on the current reference to the power supply.

The display apparatus may reduce power loss by the driving switch by controlling the driving voltage depending on the current reference of the light emitting diode.

The driving controller may be configured to decrease the current reference to decrease the driving current of the light emitting diode in response to the feedback signal being substantially equal to an allowable minimum or maximum value and the detected driving voltage being greater than the predetermined voltage.

The display apparatus may more accurately predict overheating of the light emitting diode and/or the driving switch and prevent and/or reduce overheating of the light emitting diode and/or the driving switch by monitoring the feedback signal and the driving voltage.

The driving controller may be configured to decrease the current reference to decrease the driving current of the light emitting diode in response to the detected driving voltage rising while the feedback signal does not change.

The display apparatus may more accurately predict overheating of the light emitting diode and/or the driving switch and prevent and/or reduce overheating of the light emitting diode and/or the driving switch by monitoring the feedback signal and the driving voltage.

The power supply may include a power supply circuit configured to apply the driving voltage to the light emitting diode and a test circuit configured to diagnose the power supply circuit. The driving controller may be configured to detect a change in the driving voltage in response to a change in the feedback signal using the test circuit before driving the light emitting diode.

The display apparatus may determine, in advance. a malfunction of the power supply by including a self-diagnostic circuit.

The driving controller may be configured to decrease the current reference to decrease the driving current of the light emitting diode in response to the change in the driving voltage in response to the change in the feedback signal not being detected.

The display apparatus may detect the malfunction of the power supply, in advance, by detecting the change in the driving voltage in response to the feedback signal using the self-diagnostic circuit.

The driving controller may be configured to decrease the current reference to decrease the driving current of the light emitting diode in response to the power consumption of the driving switch being greater than a predetermined power and the detected driving voltage being greater than the predetermined voltage.

The display apparatus may more accurately predict overheating of the light emitting diode and/or the driving switch and prevent and/or reduce overheating of the light emitting diode and/or the driving switch by monitoring the power consumption and the driving voltage.

The driving controller may be configured to control the power supply to stop applying the driving voltage to the light emitting diode in response to the driving voltage detected by a first voltage sensor being greater than the predetermined voltage.

The display apparatus may prevent and/or reduce overheating of the light emitting diode and/or the driving switch by stopping the operation of the power supply when detecting the overvoltage.

The display apparatus may further include a current sensor configured to detect the driving current. The driving controller may be configured to control the driving switch such that the driving current of the light emitting diode follows the current reference based on the detected driving current.

The display apparatus may include a feedback circuit for controlling the driving current, so that the driving current of the light emitting diode may follow the current reference.

According to an example embodiment, there is provided a display apparatus capable of varying a driving voltage applied to a plurality of light emitting diodes based on image data.

According to another example embodiment, there is provided a display apparatus capable of preventing and/or reducing overheating of driving switches due to a malfunction during varying of a driving voltage.

According to another example embodiment, there is provided a display apparatus capable of self-diagnosing a power supply that supplies a driving voltage to a plurality of light emitting diodes to prevent and/or reduce an overvoltage.

The various example embodiments may be implemented in the form of a recording medium storing computer-executable instructions that are executable by a processor. The instructions may be stored in the form of a program code, and when executed by the processor, the instructions may generate a program module to perform operations of the disclosed embodiments. The recording medium may be implemented as a non-transitory computer-readable recording medium.

The non-transitory computer-readable recording medium may include all kinds of recording media storing commands that can be interpreted by a computer. For example, the non-transitory computer-readable recording medium may be, for example, and without limitation, ROM, RAM, a magnetic tape, a magnetic disc, flash memory, an optical data storage device, etc.

While various example embodiments of the disclosure have been illustrated and described with reference to the accompanying drawings, it will be understood that the various example embodiments are intended to be illustrative, not limiting. It will be further understood by one of ordinary skill in the art that various changes in form and detail may be made without departing from the true spirit and full scope of the disclosure, including the appended claims and their equivalents.

What is claimed is:

1. A display apparatus comprising:

a light emitting diode;

a power supply configured to apply a driving voltage to the light emitting diode and to supply a driving current to the light emitting diode;

a driving switch configured to control the driving current of the light emitting diode;

a voltage sensor configured to detect the driving voltage; and a driving controller configured to control the driving switch so that the driving current of the light emitting diode follows a current reference and to transmit a feedback signal for adjusting the driving voltage based on the current reference to the power supply, wherein the driving controller is configured, based on the driving voltage detected by the voltage sensor being greater than a predetermined voltage, to decrease the current reference to decrease the driving current of the light emitting diode.

2. The display apparatus according to claim 1, wherein the driving controller is configured, based on a time in which the detected driving voltage is greater than the predetermined voltage being greater than a reference time, to decrease the current reference to decrease the driving current of the light emitting diode.

3. The display apparatus according to claim 1, wherein the driving controller is configured, based on the feedback signal being substantially equal to an allowable minimum or maximum value and the detected driving voltage being greater than the predetermined voltage, to decrease the current reference to decrease the driving current of the light emitting diode.

4. The display apparatus according to claim 1, wherein the driving controller is configured, based on the detected driving voltage rising while the feedback signal does not change, to decrease the current reference to decrease the driving current of the light emitting diode.

5. The display apparatus according to claim 1, wherein:

the power supply comprises a power supply circuit configured to apply the driving voltage to the light emitting diode and a test circuit configured to diagnose the power supply circuit; and the driving controller is configured to detect a change in the driving voltage, based on a change in the feedback signal, using the test circuit before driving the light emitting diode.

6. The display apparatus according to claim 5, wherein the driving controller is configured, based on no change in the driving voltage being detected, to decrease the current reference to decrease the driving current of the light emitting diode.

7. The display apparatus according to claim 1, wherein the driving controller is configured to, based on power consumption of the driving switch being greater than a predetermined power and the detected driving voltage being greater than the predetermined voltage, decrease the current reference to decrease the driving current of the light emitting diode.

8. The display apparatus according to claim 1, wherein the driving controller is configured, based on the driving voltage detected by a first voltage sensor being greater than the predetermined voltage, to control the power supply to stop applying the driving voltage to the light emitting diode.

9. The display apparatus according to claim 1, further comprising:

a current sensor configured to detect the driving current, wherein the driving controller is configured to control the driving switch such that the driving current of the light emitting diode follows the current reference based on the detected driving current.

10. A method of controlling a display apparatus comprising:

applying a driving voltage to a light emitting diode;

controlling a driving current supplied to the light emitting diode to follow a current reference;

detecting the driving voltage;

decreasing the current reference to decrease the driving current of the light emitting diode based on the detected driving voltage being greater than a predetermined voltage; and based on the detected driving voltage rising while a feedback signal for adjusting the driving voltage does not change, decreasing the current reference to decrease the driving current of the light emitting diode.

11. The method according to claim 10, wherein the decreasing of the current reference comprises:

based on a time in which the detected driving voltage is greater than the predetermined voltage being greater than a reference time, decreasing the current reference to decrease the driving current of the light emitting diode.

12. The method according to claim 10, further comprising:

based on the driving voltage detected by a first voltage sensor being greater than the predetermined voltage, stopping applying the driving voltage to the light emitting diode.

13. The method according to claim 10, further comprising:

based on a change in the driving voltage not being detected while the feedback signal for adjusting the driving voltage is changing, decreasing the current reference to decrease the driving current of the light emitting diode.

14. A display apparatus comprising:

a light emitting diode;

a power supply configured to apply a driving voltage to the light emitting diode and to supply a driving current to the light emitting diode;

a driving switch configured to control the driving current of the light emitting diode;

an edge sensor configured to detect a change in the driving voltage; and a driving controller configured to control the driving switch so that the driving current of the light emitting diode follows a current reference, and to transmit a feedback signal for adjusting the driving voltage based on the current reference to the power supply, wherein the driving controller is configured, based on the detected driving voltage rising while the feedback signal does not change, to decrease the current reference to decrease the driving current of the light emitting diode.

15. The display apparatus according to claim 14, wherein the driving controller is configured, based on the feedback signal being substantially equal to an allowable minimum or maximum value and the detected driving voltage being greater than a predetermined voltage, to decrease the current reference to decrease the driving current of the light emitting diode.

16. The display apparatus according to claim 14, wherein:

the power supply comprises a power supply circuit configured to apply the driving voltage to the light emitting diode and a test circuit configured to diagnose the power supply circuit; and the driving controller is configured to detect a change in the driving voltage, based on a change in the feedback signal, using the test circuit before driving the light emitting diode.

17. The display apparatus according to claim 16, wherein the driving controller is configured, based on no change in the driving voltage being detected, to decrease the current reference to decrease the driving current of the light emitting diode.

18. The display apparatus according to claim 16, wherein the driving controller is configured, based on the detected driving voltage rising while the feedback signal does not change, to control the power supply to stop applying the driving current to the light emitting diode.

* * * * *